US005420616A

United States Patent [19]

Suemitsu et al.

[11] Patent Number: 5,420,616

[45] Date of Patent: May 30, 1995

[54] ELECTROSTATIC RECORDING METHOD AND APPARATUS WITH RECORDING HEAD TIMING CONTROL

[75] Inventors: Yuji Suemitsu; Koji Masuda; Kazuo Asano; Akinori Komura, all of Kanagawa, Japan

[73] Assignee: Fuji Xerox Co., Ltd, Tokyo, Japan

[21] Appl. No.: 644,974

[22] Filed: Jan. 23, 1991

[30] Foreign Application Priority Data

Jan. 23, 1990 [JP] Japan ..... 2-11681
Jan. 23, 1990 [JP] Japan ..... 2-11682

[51] Int. Cl.[6] ..... B41J 2/415
[52] U.S. Cl. ..... 347/154
[58] Field of Search ..... 346/1.1, 153.1, 154, 346/155, 159, 160

[56] References Cited

U.S. PATENT DOCUMENTS 4,494,129 1/1985 Gretchev ..... 346/154
4,575,739 3/1986 De Schamphelaere et al. ... 346/160
4,801,978 1/1989 Lama et al. ..... 346/160 Y

*Primary Examiner*—Joan H. Pendegrass
*Attorney, Agent, or Firm*—Finnegan, Henderson, Farabow, Garrett & Dunner

[57] ABSTRACT

A latent electrostatic image is formed on a rotatable latent image carrying body in a matrix form by an electrostatic recording head. An encoder outputs a pulse signal having a period which reflects a rotational speed of the latent image carrying body. A timing signal to be used for driving the recording head is generated based on the pulse signal and control information which has been produced based on the pulse signal and indicates a proper drive period of the timing signal. In another method, the period of the pulse signal is corrected so as to become consistent with a pitch, in the rotational direction of the latent image carrying body, of matrix elements of the recording head. The timing signal is generated based on the corrected pulse signal.

9 Claims, 18 Drawing Sheets

ENCODER SIGNAL
DRIVE ELECTRODE SIGNAL
T1
Td1
Tw1

ENCODER SIGNAL
DRIVE ELECTRODE SIGNAL
T2

ENCODER SIGNAL
DRIVE ELECTRODE SIGNAL
T2
Td2
Tw2

ELECTROSTATIC RECORDING METHOD AND APPARATUS WITH RECORDING HEAD TIMING CONTROL

BACKGROUND OF THE INVENTION

The present invention relates to an electrostatic recording method and apparatus used in machines such as printers and facsimile machines. More particularly, it is directed to an electrostatic recording method and apparatus for electrostatically recording images by emitting ions in accordance with an image signal.

Conventional electrostatic recording apparatuses of this type include the following. As shown in FIG. 1, an electrostatic recording head 101 is disposed so as to confront a dielectric drum 100 and it forms a desired latent electrostatic image on the dielectric drum 100.

As shown in FIGS. 2 and 3, the electrostatic recording head 101 has a plurality of drive electrodes 103, 103, . . . in parallel with each other on the front surface of an insulating substrate 102 and a plurality of control electrodes 104, 104 . . . so as to intersect the drive electrodes 103, 103, . . . on the back surface thereof so that a matrix is formed by both electrodes 103, 103, . . . and 104, 104, . . . . On the control electrodes 104, 104, . . . are opening portions 105, 105, . . . serving as discharge generating regions at such positions as to intersect the drive electrodes 103, 103, . . . formed, respectively. Since these opening portions 105, 105, . . . formed on the control electrodes 104, 104, . . . are arranged at positions where the drive electrodes 103, 103, . . . and the control electrodes 104, 104, . . . , both constituting the matrix, intersect each other, the opening portions 105, 105, . . . themselves become part of the matrix as shown in FIG. 2.

As shown in FIGS. 4 and 5, on the lower surface of the control electrodes 104, 104, . . . is a screen electrode 107 formed through an insulating layer 106, while the insulating layer 106 and the screen electrode 107 have, as shown in FIG. 5, opening portions 108, 108, . . . and ion guiding opening portions 109, 109, . . . at positions corresponding to the opening portions 105, 105, . . . of the control electrodes 104, 104, . . . . As shown in FIG. 5, the electrostatic recording head 101 applies not only an ac voltage to the drive electrode 103 but also a dc voltage to the screen electrode 107. The head 101 also applies a pulsed high voltage selectively to the control electrodes 104, 104, . . . in accordance with an image signal.

Accordingly, as shown in FIG. 6, creeping corona discharge occurs at the opening portions 105, 105, . . . between the drive electrodes 103, 103, . . . and the control electrodes 104, 104, . . . to which the high voltage has been selectively applied. And a stream of ions generated by the creeping corona discharge is either accelerated or absorbed by an electric field generated between the control electrodes 104, 104, . . . and the screen electrode 107, thereby causing a latent electrostatic image to be formed on the dielectric drum 100 by the ions in accordance with the image signal.

To form a desired latent electrostatic image on the dielectric drum 100, emission of the ions must be controlled. Since the ions are emitted from the opening portions 105, 105, . . . and these opening portions 105, 105, . . . constitute the matrix, such control naturally involves the drive electrodes 103, 103, . . . and the control electrodes 104, 104, . . . , which will be driven in the following manner in synchronism with rotation of the dielectric drum 100.

As shown in FIG. 1, an encoder 110 is fixed on the rotating shaft of the dielectric drum 100 and it detects the speed of rotation or position of the dielectric drum 100. As shown in FIG. 7, while one period T of a pulse is being outputted from the encoder 110, the plurality of drive electrodes 103, 103, . . . are sequentially driven by a predetermined pulse width Tw every electrode, and a pulsed voltage is applied to the control electrodes 104, 104, . . . for recording the latent electrostatic image in synchronism therewith.

In this way, the creeping corona discharge occurs at the opening portions 105, 105, . . . between the drive electrodes 103, 103, . . . and the control electrodes 104, 104, . . . . to which the voltage has been applied; the stream of ions produced by the creeping corona discharge is accelerated or absorbed by the electric field generated between the control electrodes 104, 104, . . . and the screen electrode 107; the emission of the ions are controlled; and the latent electrostatic image is formed on the dielectric drum 100 in accordance with the image signal.

For example, to record a linear image by the electrostatic recording head 101, not only the ac voltage is applied to the drive electrodes 103, 103, . . . sequentially in synchronism with the rise of a pulse outputted from the encoder 110, but also the pulsed voltage is applied to the control electrodes 104, 104, . . . in synchronism with driving each of the drive electrodes 103, 103, . . . as shown in FIG. 7. Specifically, a control electrode is turned on when a No. 1 drive electrode has been driven. Then, when the latent electrostatic image formed at that timing has reached a No. 2 drive electrode as the dielectric drum 100 moves, the control electrode is turned on (while the dielectric drum 100 is moving, the control electrode is kept off). By repeating this operation, the linear latent electrostatic image is formed on the dielectric drum 100 by movement of the dielectric drum 100 as shown in FIG. 8.

The latent electrostatic image thus formed on the dielectric drum 100 is developed by a developing unit 111 shown in FIG. 1 to form a toner image, and this toner image is transferred and simultaneously fused by pressure onto a recording sheet 113 supplied to a nip portion between the dielectric drum 100 and a pressure roller 112 that is in pressure contact therewith. As a result, the image is recorded on the recording sheet 113. In FIG. 1, reference numeral 114 designates a cleaner that removes toner remaining on the surface of the dielectric drum 100 after the toner image has been transferred and fused as described above; and 115, a discharge unit for removing charge remaining on the surface of the dielectric drum 100.

However, the above prior art imposes the following problems. The electrostatic recording apparatus transfers and fuses the toner image formed on the dielectric drum 100 surface onto the recording sheet 113 by pressure from both the dielectric drum 100 and the pressure roller 112 that is in pressure contact therewith. As a result, when the recording sheet 113 is threading into the nip portion between the dielectric drum 100 and the pressure roller 112 as shown in FIG. 9(*a*), the contact pressure between the dielectric drum 100 and the pressure roller 112 is increased instantaneously, causing the speed of rotation of the dielectric drum 100 to be decreased instantaneously as shown by A in FIG. 10 and then returned to the original speed after some vibration.

Thereafter, when the recording sheet 113 passes through the nip portion between the dielectric drum 100 and the pressure roller 112 as shown in FIG. 9(*b*), the speed of rotation of the dielectric drum 100 is maintained at a predetermined steady-state level as shown by B in FIG. 10. Similarly, when the recording sheet 113 exits from the nip portion between the dielectric drum 100 and the pressure roller 112 as shown in FIG. 9(*c*), the contact pressure between the dielectric drum 100 and the pressure roller 112 is decreased instantaneously, causing the speed of rotation of the dielectric drum 100 to be increased instantaneously as shown by C in FIG. 10 and then returned to the original speed after some vibration.

Thus, the speed of rotation of the dielectric drum 100 undergoes a drastic change as the recording sheet 113 passes through the nip portion between the dielectric drum 100 and the pressure roller 112. As a result, with respect to the pulse outputted from the encoder 110 which determines the timing for driving the electrostatic recording head 101 by detecting the speed of rotation of the dielectric drum 100, its period T also undergoes a change as the recording sheet 113 passes through the nip portion as shown in FIG. 11.

In contrast thereto, the output of an electrostatic recording head 101 drive signal is started in synchronism with the rise of the pulse outputted from the encoder 110 as shown in FIG. 7, and is then continued in the form of a pulse signal so that the drive electrodes 103, 103, . . . can be driven sequentially at the predetermined pulse width Tw and interval Td.

As a result, when the speed of rotation of the dielectric drum 100 becomes lower than a predetermined speed as the recording sheet 113 passes through the nip portion and the period of the pulse outputted from the encoder 110 becomes longer than a predetermined interval, the head drive signal becomes relatively shorter by Δt1 as shown in FIG. 11. Similarly, when the speed of rotation of the dielectric drum 100 becomes higher than the predetermined speed and the period of the pulse outputted from the encoder 110 becomes shorter than the predetermined interval as shown in FIG. 11, the head drive signal becomes relatively longer by Δt2.

As a result, the interval of the dot-like ions emitted from the opening portions 109, 109, . . . on the electrostatic recording head 101 driven by the head drive signal desynchronizes with rotation of the dielectric drum 100, causing irregular distortion to the image to be recorded on the dielectric drum 100 as the recording sheet 113 passes through the nip portion as shown in FIG. 12 (in case of recording, e.g., a Chinese character "□□□" by the electrostatic recording head 101), with resultant impairment in image quality.

Further, the above prior art apparatus entails the following problems. The head drive signals received by the drive electrodes 103, 103, . . . and the control electrodes 104, 104, . . . include drive electrode signals and control electrode signals as shown in FIG. 7, and the ions are emitted in the form of dots only from the opening portions 109, 109, . . . to which both electrode signals have been applied simultaneously to form a latent electrostatic image.

In FIG. 13, when a first drive electrode 103 and a first control electrode 104 receive a pulsed voltage simultaneously, a dot d1 is printed. And as shown in FIG. 7, during one period T of a pulse outputted from the encoder 110, the drive electrode signal 111 drives the first to fifth drive electrodes 103, 103, . . . sequentially at a predetermined pulse width Tw and a predetermined pulse interval Td, driving the control electrodes 104, 104, . . . in synchronism with the drive electrode signal 111, while sequentially printing dots d1, d2, d3, d4, and d5. Adjacent to the dots d1, d2, d3, d4, d5 are dots d1', d2', d3', d4', d5' printed simultaneously therewith.

When a next pulse is outputted from the encoder 110 as the dielectric drum 100 rotates as shown in FIG. 7, the drive electrodes 103 are driven sequentially starting with the first drive electrode in a manner similar to the above. Since the dielectric drum 100 is being rotated, a dot d6 is printed at a position in a dielectric drum 100 rotating direction A adjacent to the already recorded dot d1 by the electrostatic recording head 101 as shown in FIG. 13. Thereafter, as the dielectric drum 1 further rotates, dots such as dots d11, d16, d21, d26, d31, d36, d41 are sequentially printed in the matrix form in the dielectric drum 100 rotating direction A every time a pulse is outputted from the encoder 110 on a period basis, thereby recording the desired image. As a result, the forty-first dot d41 comes into line contiguous to the fifth dot d5' printed by the first pulse outputted from the encoder 110.

By the way, upon output of a pulse from the encoder 110, the positions of the dots d1, d2, . . . d5 are basically defined by the pitch of the drive electrodes 103, 103, . . . on the electrostatic recording head 101, while the positions of the dots d1, d6, d11, . . . , which are sequentially recorded in the dielectric drum 100 rotating direction A every time a pulse is outputted from the encoder 110, are defined by the pitch of the pulses outputted from the encoder 110.

Any variation in the pitch of the drive electrodes 103, 103, . . . due to inaccuracy in their fabrication, error in the number of pulses outputted from the encoder 110, or any dimensional error in the diameter of the dielectric drum 100 may cause incoincidence between the pitch d of the dots printed in accordance with the adjacent drive electrodes 103, 103, . . . on the electrostatic recording head 101 and the value obtained by multiplying by a predetermined integer n (n=2 in an example shown in FIG. 21) the pitch P of the dots sequentially printed in accordance with the pulses outputted from the encoder 110 as shown in FIG. 13. Therefore, for example, the dot d41 that should be printed contiguous to the dot d5' is printed out of place from the dielectric drum 100 rotating direction A. As a result, in recording the Chinese character "□□□" such as shown in FIG. 14, the horizontal line of the character appears as being regularly saw-toothed, thereby greatly impairing the image quality.

This problem can be analyzed quantitatively as follows.

Let it be supposed that one period of a pulse outputted from the encoder 110 is T and that the time required for recording a single dot by the electrostatic recording head 101 is TD (=Tw+Td). Then, T and TD can be expressed as follows.

$$T=P/v \quad (1)$$

$$TD=T/N=P/Nv \quad (2)$$

where P is the pitch of the dots printed contiguously in the dielectric drum 100 rotating direction A, v is the circumferential velocity of the dielectric drum 100, and N is the number of drive electrodes 103, 103, . . . as shown in FIG. 13.

If the drive electrodes 103, 103, . . . are sequentially driven at the predetermined pulse width Tw and pulse interval Td to record the dots d1, d2, d3, . . . d5 in the order as written, the interval d between the dots d1 and d2 to be recorded on the dielectric drum 100 will be set to a multiple of an integer n (n=2 in FIG. 13) of the pitch P between the dots, because the dielectric drum 100 rotates within that time. However, this pitch d is equal to a value obtained by adding a distance for which the dielectric drum 100 moves during the time TD to a geometrical interval d' between the drive electrodes 103, 103, . . . on the electrostatic recording head 101. Thus, the interval d can be expressed as follows in consideration of equation (2).

$$d=nP=d'+vTD=d'+P/N \quad (3).$$

Hence, the pitch P can be defined as follows by modifying equation (3).

$$P=d'/(n-1/N) \quad (4).$$

On the other hand, if the diameter of the dielectric drum 100 is Q, the number of pulses generated per one full rotation of the encoder 110 is NE, the pitch P' determined by the pulse outputted from the encoder 110 is given as follows.

$$\therefore P'=\rho l/NE \quad (5).$$

Here, if the pitch P between the dots to be printed contiguous to each other in the dielectric drum 100 rotating direction A coincides with the pitch P' determined by the pulse outputted from the encoder 110, there will be no dots which are out of place in the printed image.

Let us think about the case where a 10-dots/mm printing is performed on a dielectric drum 100 whose diameter is 200 mm using an electrostatic recording head 101 in which the interval d' between the drive electrodes 103, 103, . . . viewed from the dielectric drum 100 is 0.2 mm, n is 2, and the number N of drive electrodes 103, 103, . . . is 5. If the number of pulses NE outputted per rotation of the encoder 110 is 6000, then the pitch P to be given by equation (4) is as follows.

$$P=0.2/(2-1/5)\simeq 0.111.$$

The pitch P' to be given by equation (5) is as follows.

$$P'=200\rho/6000\simeq 0.105.$$

Hence, there results a difference of 0.006 mm between both pitches P and P', causing a dislocation which is 8 times that difference, i.e., 0.048 mm, between the dot 41 and the dot d5'.

This dislocation is brought about by incoincidence between the pitch P of the dots printed contiguous to each other in the dielectric drum 100 rotating direction A and the pitch P' determined by the pulse outputted from the encoder 110.

Therefore, as the dislocation is aggravated with increasing variation in the interval d' between the drive electrodes 103, 103, . . . on the electrostatic recording head 101 and with increasing errors of the number NE of pulses outputted from the encoder 110 or of the diameter of the dielectric drum 100.

As a result, the horizontal line of the character is printed regularly saw-toothed when an image is recorded, thereby imposing the problem of greatly impairing the image quality.

SUMMARY OF THE INVENTION

The present invention has been made to overcome the above problems associated with the prior art. Accordingly, an object of the invention is to provide an electrostatic recording method and apparatus which are capable of recording distortion-free high-quality images by controlling the timing for driving an electrostatic recording head even in the case where the speed of rotation of a latent image carrying body undergoes a change by the threading of a recording member into the nip portion between the latent image carrying body and a pressure roller that is in pressure contact therewith.

Another object of the invention is to provide an electrostatic recording method and apparatus which are capable of recording high-quality images without printing the dots dislocated in the recorded image even in the case where there is a difference between the pitch according to the interval of drive electrodes of an electrostatic recording head and the pitch according to the pulses outputted from an encoder.

According to a first aspect of the invention, an electrostatic recording method basically comprises the steps of: forming a latent electrostatic image on a rotating latent image carrying body by an electrostatic recording head that emits ions in a matrix form in accordance with an image signal; and developing the formed latent electrostatic image to record an image. In such a method, the speed of rotation of the latent image carrying body is detected so that the timing for driving the electrostatic recording head can be controlled in accordance with a change in the detected speed of rotation of the latent image carrying body.

An electrostatic recording apparatus of the invention comprises: an electrostatic recording head which records a latent electrostatic image by emitting ions in a matrix form in accordance with an image signal; a latent image carrying body which is rotatable and which carries the latent electrostatic image formed by the electrostatic recording head; pulse generating means which generates a pulse signal as the latent image carrying body rotates; output control pulse generating means which generates a pulse for controlling the output of the electrostatic recording head based on the pulse signal from the pulse generating means; and control means which controls the output of the output control pulse generating means based on the period of the pulse signal from the pulse generating means.

The control means may include: 1/N period measuring means which measures the period of the pulse signal outputted from the pulse generating means and then calculates a value which is 1/N of the measured pulse period (where N is a value characteristic of a matrix of the electrostatic recording head); and subtracter means which subtracts a predetermined pulse width of the output control pulse from the 1/N period measured by the 1/N period measuring means to obtain an interval at which the output control pulse is to be outputted.

The control means may include: period measuring means which measures the period of the pulse signal outputted from the pulse generating means; and storage means which stores the period of the output control pulse optimally applied to the period measured by the period measuring means.

The control means may include limiter means which outputs the output control pulse in accordance with a predetermined pattern if, e.g., the period of the pulse signal outputted from the pulse generating means is smaller than a predetermined value.

In the electrostatic recording method of the invention, the speed of rotation of the latent image carrying body is detected so that the timing for driving the electrostatic recording head can be controlled in accordance with a change in the speed of rotation of the latent image carrying body. Therefore, even in the case where the speed of rotation of the latent image carrying body is changed due to the recording member passing through the nip portion between the latent image carrying body and the pressure roller that is in pressure contact therewith, the timing for driving the electrostatic recording head can be controlled in accordance with the moving speed of the latent image carrying body, thereby allowing the electrostatic recording head to be driven in synchronism with the speed of rotation of the latent image carrying body at all times.

Further, according to the electrostatic recording apparatus of the invention, the speed of rotation of the latent image carrying body is detected by the pulse generating means, and the output of the output control pulse from the output control pulse generating means can be controlled by the control means based on the period of the pulse signal outputted from the pulse generating means. As a result, even in the case where the speed of rotation of the latent image carrying body is changed due to the recording member passing through the nip portion between the latent image carrying body and the pressure roller that is in pressure contact therewith, the head drive signal does not become $\Delta t1$ shorter or $\Delta t2$ longer as shown in FIG. 15, thereby allowing the electrostatic recording head to be driven in synchronism with the speed of rotation of the latent image carrying body at all times.

According to a second aspect of the invention, an electrostatic recording method basically comprises the steps of: forming a latent electrostatic image on a rotating latent image carrying body by an electrostatic recording head which emits ions in a matrix form in accordance with an image signal; and making the latent electrostatic image real by developing the latent electrostatic image. In such a method, the speed of rotation or position of the latent image carrying body is detected; the detected speed of rotation or position of the latent image carrying body is then corrected; and the timing for driving the electrostatic recording head is controlled in accordance with the corrected speed of rotation or position of the latent image carrying body.

An electrostatic recording apparatus of the invention comprises: an electrostatic recording head for recording a latent electrostatic image by emitting ions in a matrix form in accordance with an image signal; a latent image carrying body which is rotatable and which carries the latent electrostatic image formed by the electrostatic recording head; pulse generating means for generating a pulse signal for controlling the output of the electrostatic recording head at a predetermined period as the latent image carrying body rotates; and pulse period correcting means for correcting the period of a pulse signal outputted from the pulse generating means. In such a apparatus, the output of the electrostatic recording head is controlled by the pulse signal corrected by the pulse period correcting means.

The pulse period correcting means may include: period measuring means for measuring the period of the pulsesignal; correction rate setting means for setting a rate of correction of the period; and multiplier means for multiplying the pulse period by the correction rate.

In the electrostatic recording method of the invention, the speed of rotation or position of the latent image carrying body is detected; the detected speed of rotation or position of the latent image carrying body is corrected; and the timing for driving the electrostatic recording head is controlled in accordance with the corrected speed of rotation or position of the latent image carrying body. Therefore, even if there is a difference between the pitch according to the interval of the drive electrodes of the electrostatic recording head and the pitch according to the detected speed of rotation or position of the latent image carrying body, the detected speed of rotation or position of the latent image carrying body can be corrected and the timing for driving the electrostatic recording head can be controlled in accordance with the corrected speed of rotation or position of the latent image carrying body. As a result, the electrostatic recording head can be driven in agreement with the interval between the drive electrodes, thereby preventing the dots constituting the recorded image from being printed out of place.

Further, according to the electrostatic recording apparatus of the invention, even if there is a difference between the pitch according to the interval of the drive electrodes of the electrostatic recording head and pitch according to the detected speed of rotation or position of the latent image carrying body, the output of the electrostatic recording head can be controlled by the pulse corrected by the pulse period correcting means. As a result, the pitch between the drive electrodes on the electrostatic recording head and the pitch between the pulses outputted from the pulse generating means can be made equal to each other, thereby preventing the dots forming the recorded image from being printed out of place.

The invention is particularly effective when applied to the electrostatic recording method, in which a latent electrostatic image is formed on a rotating latent image carrying body by an electrostatic recording head that records the latent electrostatic image while emitting ions in a matrix form in accordance with an image signal; the formed latent electrostatic image is developed to produce a real image; and thereafter the developed real image is transferred and fused by pressure onto a recording member fed to a nip portion between the latent image carrying body and a pressure roller that is in pressure contact therewith. However, the application of the invention is not limited thereto but may, of course, include recording apparatuses other than those which record images by transferring and simultaneously fusing the developed image that has been formed on the latent image carrying body.

DESCRIPTION OF THE PREFERRED EMBODIMENTS

Embodiments of the invention will now be described with reference to the accompanying drawings.

Figure 16:
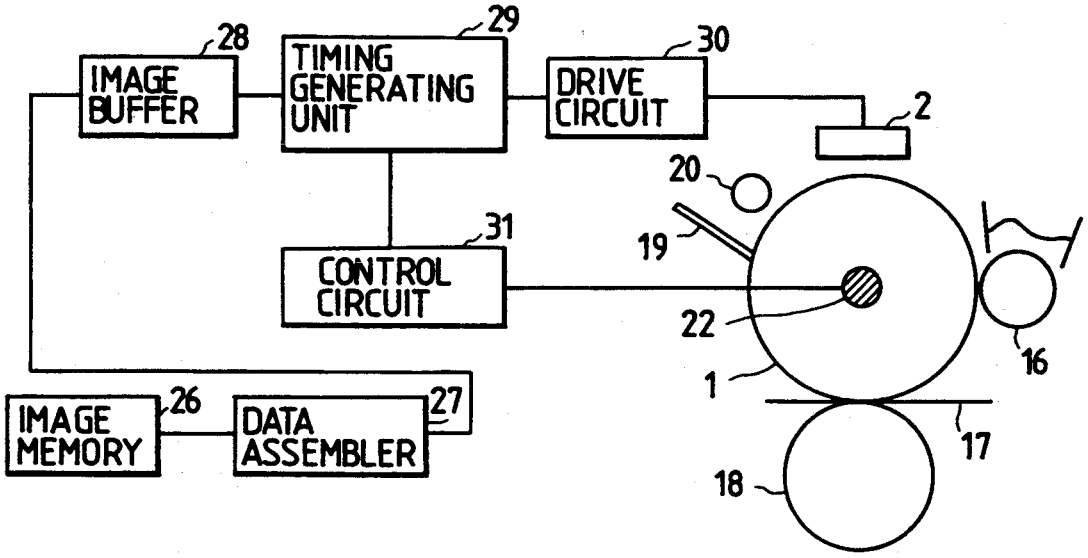
FIG. 16 is a diagram showing the configuration of an electrostatic recording apparatus to which the electrostatic recording method of FIG. 15 can be applied.

FIG. 16 shows an electrostatic recording apparatus, which is an embodiment of the invention. In FIG. 16, reference numeral 1 designates a dielectric drum serving as a latent image carrying body. The dielectric drum 1 is rotatable in a direction indicated by an arrow by drive means (not shown). On the upper portion of the dielectric drum 1 is an electrostatic recording head 2 arranged so as to confront the dielectric drum 1 with a predetermined gap.

Figure 17:
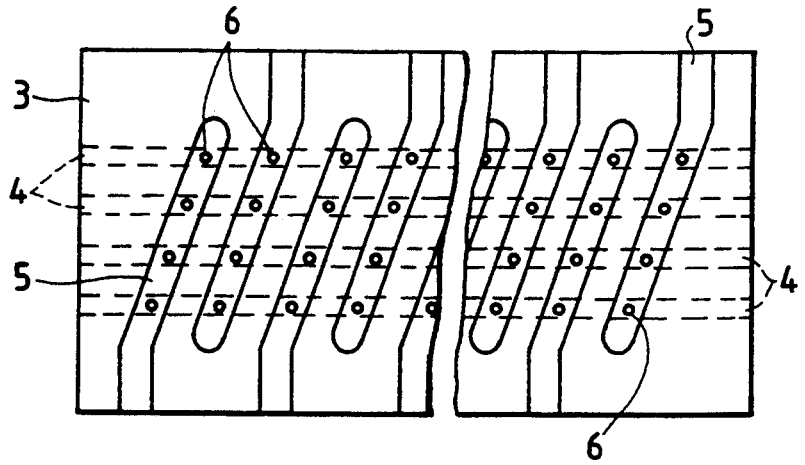
FIGS. 17 and 18 are a plan view and a sectional view showing an ion generating section of an electrostatic recording head.
Figure 18:
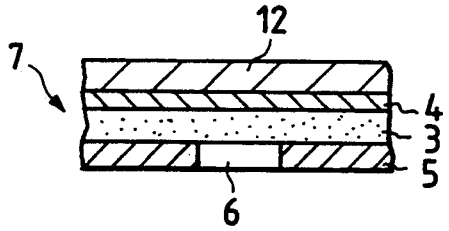

As shown in FIG. 17, the electrostatic recording head 2 has a flat, rectangular first insulating substrate 3. On the front surface of the first insulating substrate 3 are a plurality of linear drive electrodes 4, 4, . . . so as to be in parallel with each other, while on the back surface of the insulating substrate 3 are a plurality of control electrodes 5, 5, . . . so as to intersect the drive electrodes 4, 4, . . . . Both electrodes 4, 4, . . . and 5, 5, . . . constitute a matrix. The control electrodes 5, 5, . . . have circular opening portions 6, 6, . . . serving as spaces for causing a creeping corona discharge at positions where the control electrodes 5, 5, . . . intersect the drive electrodes 4, 4, . . . as shown in FIG. 18. As the drive electrodes 4, 4, . . . and the control electrodes 5, 5, . . . constitute the matrix, so do these opening portions 6, 6, . . . , located at their intersecting points as shown in FIG. 17. The first insulating substrate 3, the drive electrodes 4, 4, . . . , and the control electrodes 5, 5, . . . constitute an ion generating section 7 as shown in FIG. 18.

Figure 19:
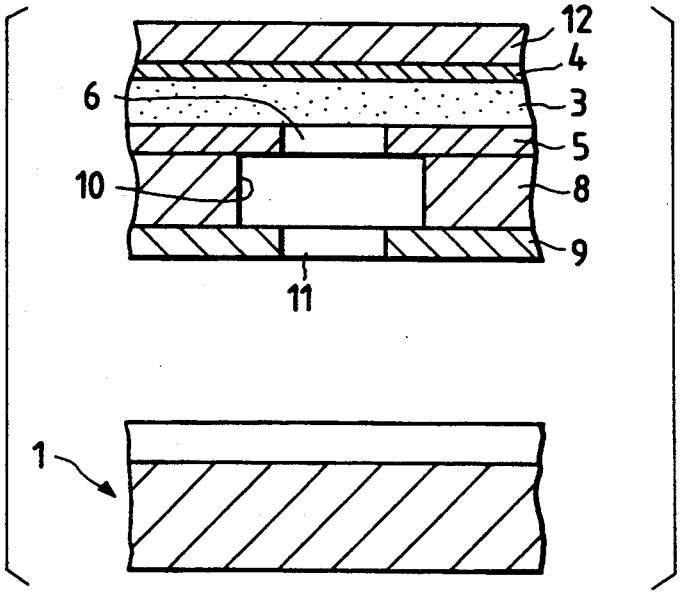
FIGS. 19 and 20 are a sectional view and a plan view showing the electrostatic recording head.
Figure 20:
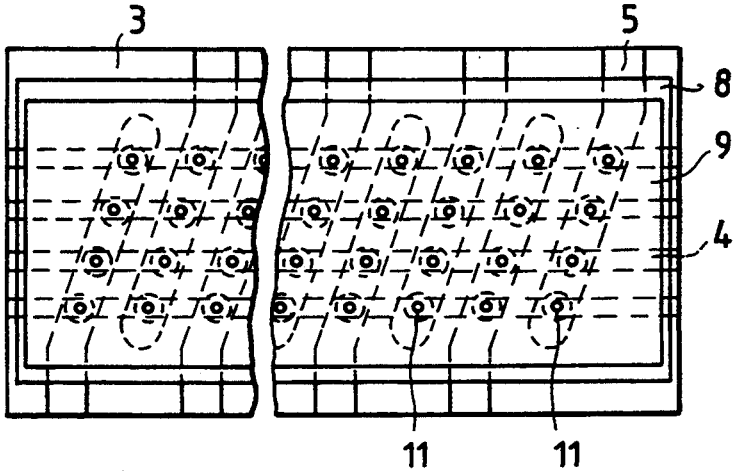

As shown in FIG. 19, below the control electrodes 5, 5, . . . of the ion generating section 7 is a screen electrode 9 arranged through a spacer layer 8 serving as a second insulating substrate. As shown in FIG. 20, the spacer layer 8 has a flat, rectangular form which is substantially equal in length and slightly narrower in width to the first insulating substrate 3. The space layer 8 is bonded to the first insulating substrate 3 by means of an adhesive or the like. As shown in FIG. 19, the spacer layer 8 has opening portions 10, 10, . . . which are larger than the opening portions 6, 6, . . . at positions corresponding to the opening portions 6, 6, . . . of the control electrodes 5, 5, . . . . Similarly, the screen electrode 9 has opening portions 11, 11, . . . serving as ion guiding regions at positions corresponding to the opening portions 6, 6, . . . of the control electrodes 5, 5, . . . .

In FIG. 18, reference numeral 12 designates a head substrate that covers the surface of the drive electrodes 4, 4, . . . .

Figure 21:
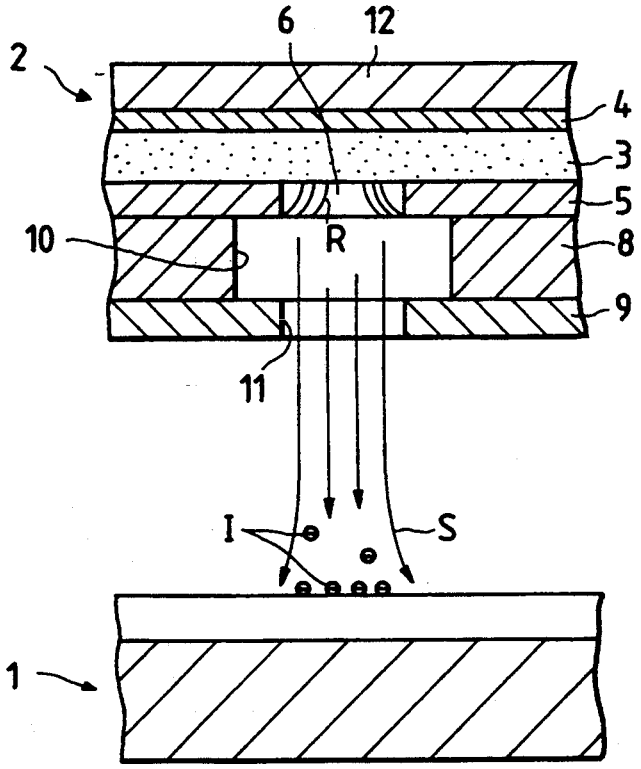
FIG. 21 is a sectional view showing an operation of the electrostatic recording head.

Each drive electrode 4 and each control electrode 5 receive pulsed drive signals as will be described later. As shown in FIG. 21, a creeping corona discharge R is generated at the opening portions 6, 6, . . . between the drive electrodes 4, 4, . . . and the control electrodes 5, 5, . . . to which a voltage is applied selectively, and a stream of ions S generated by the creeping corona discharge R is accelerated by an electric field generated between the control electrodes 5, 5, . . . and the screen electrode 9. Then, the ion stream S is emitted from the opening portions 11, 11, . . . of the screen electrode 9 under control, so that a latent electrostatic image is formed by ions I in accordance with an image signal.

Figure 1:
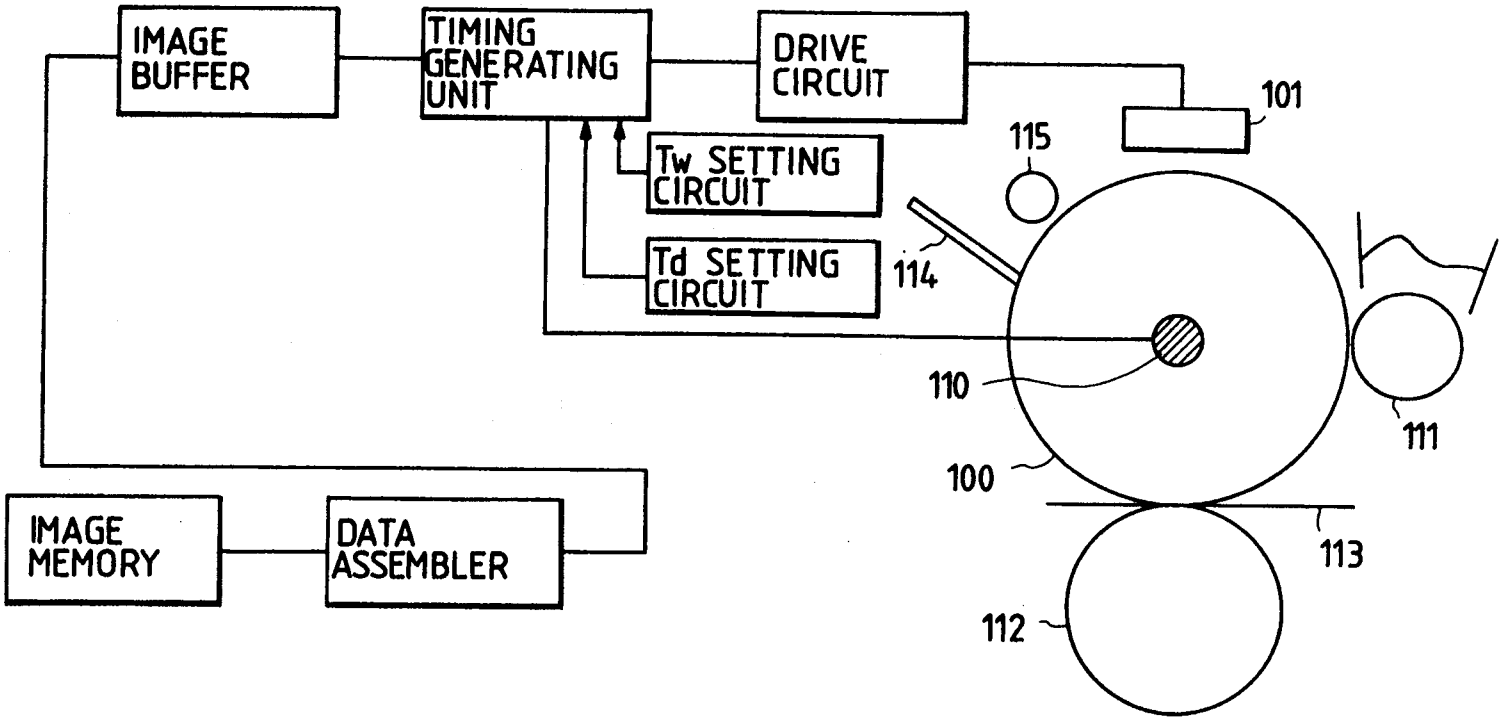
FIG. 1 PRIOR ART
FIG. 1 is a diagram showing the configuration of a conventional electrostatic recording apparatus.
Figure 2:
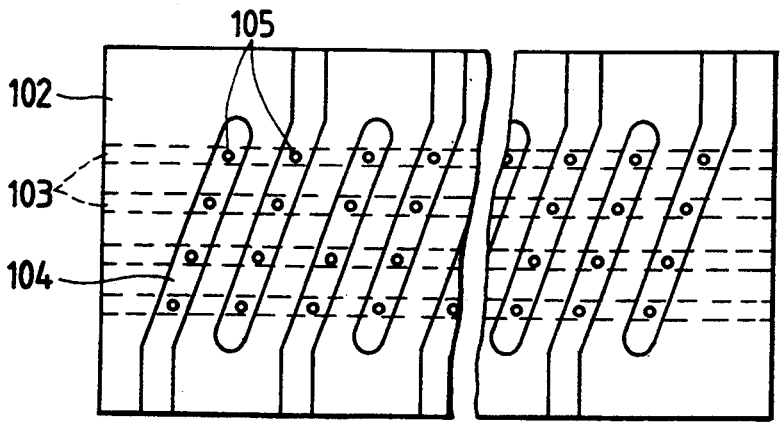
FIG. 2 PRIOR ART
FIGS. 2 and 3 are a plan view and a sectional view showing an ion generating section of an electrostatic recording head shown in FIG. 1.
Figure 3:
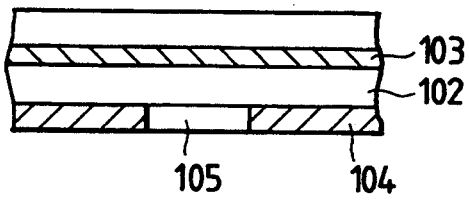
FIG. 3 PRIOR ART
Figure 4:
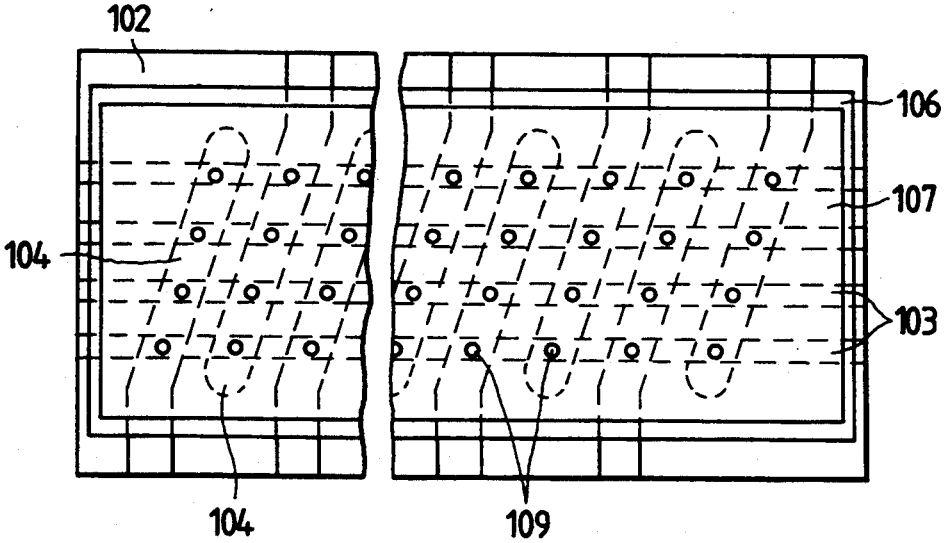
FIG. 4 PRIOR ART
FIGS. 4 and 5 are a plan view and a sectional view showing the electrostatic recording head shown in FIG. 1.
Figure 5:
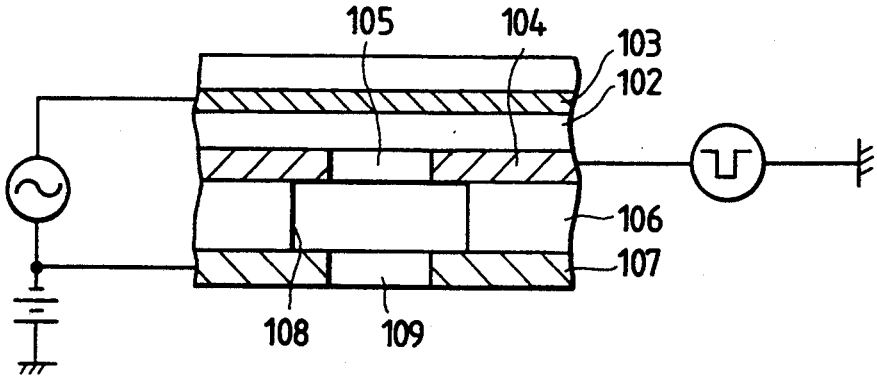
FIG. 5 PRIOR ART
Figure 6:
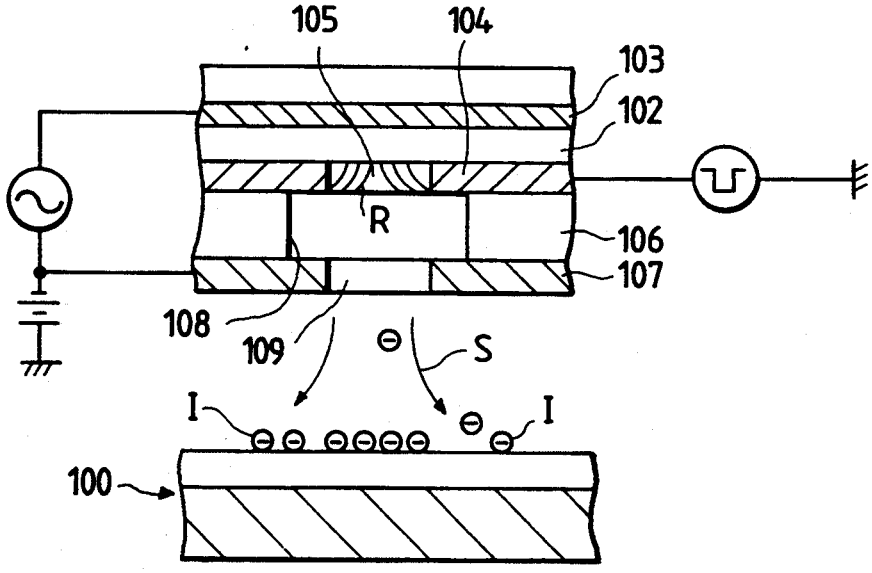
FIG. 6 PRIOR ART
FIG. 6 is a sectional view showing an operation of the electrostatic recording head shown in FIG. 1.
Figure 7:
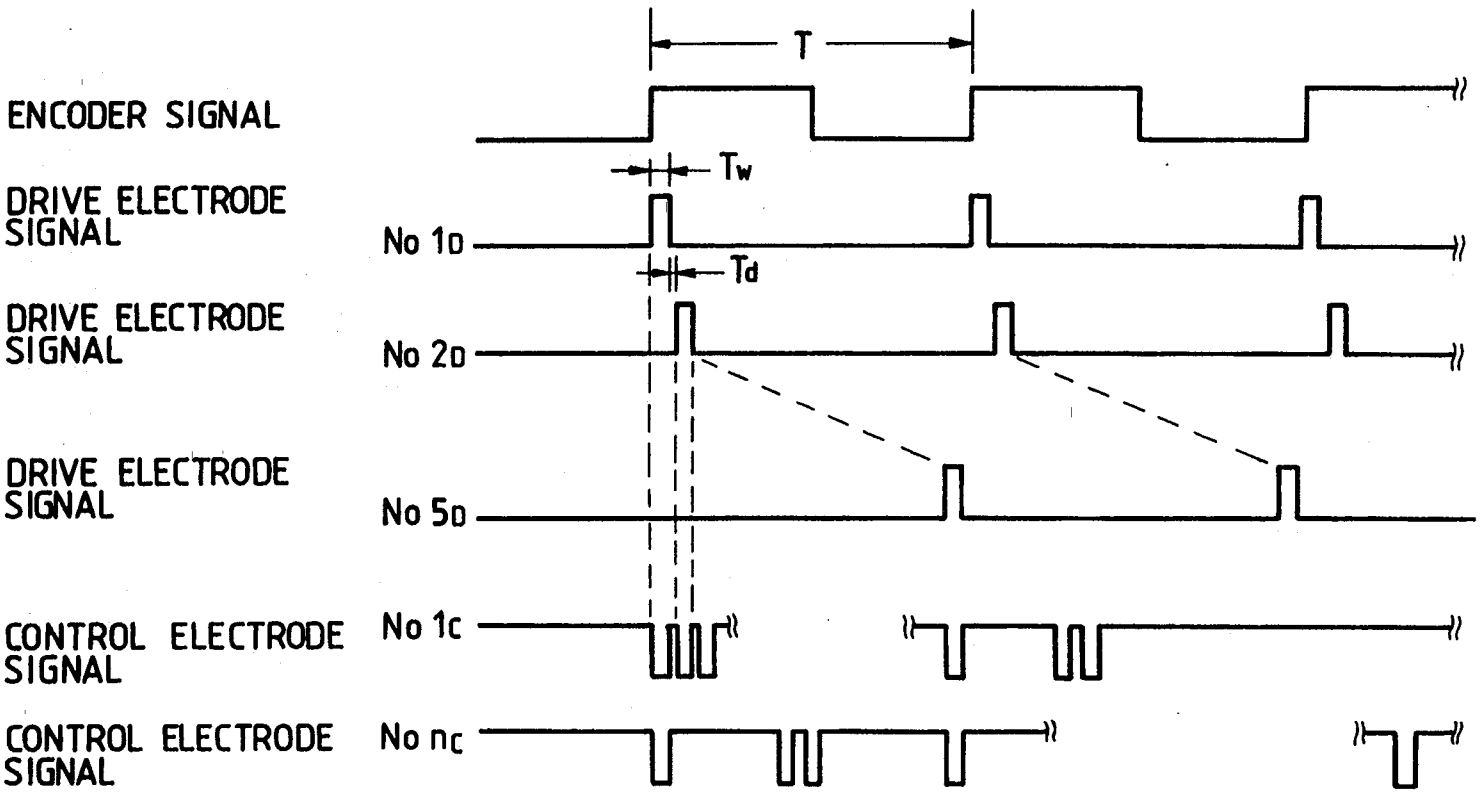
FIG. 7 PRIOR ART
FIGS. 7 and 8 are a timing chart and a diagram for a description of a recording operation of the electrostatic recording head shown in FIG. 1.
Figure 8:
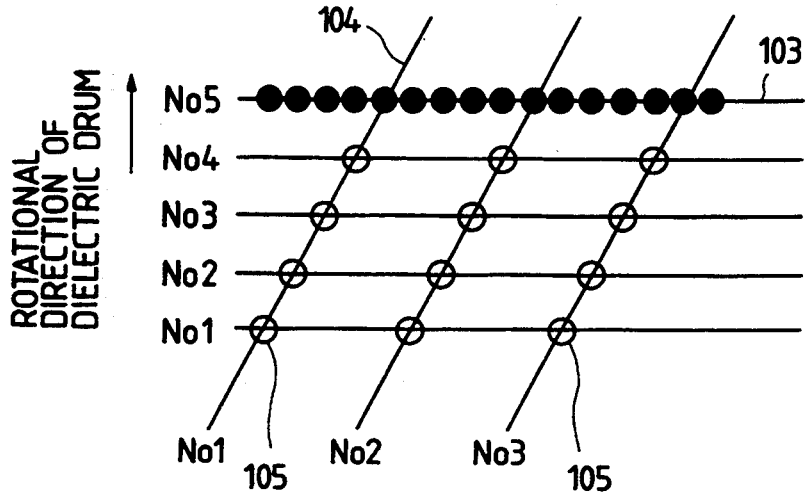
FIG. 8 PRIOR ART
Figures 9A, 9B, 9C:
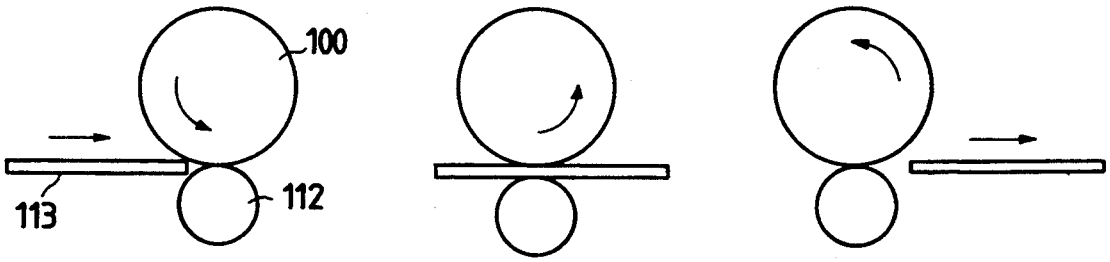
FIG. 9(a) PRIOR ART FIG. 9(b) PRIOR ART FIG. 9(c) PRIOR ART
FIGS. 9(*a*), 9(*b*) and 9(*c*) are diagrams for a description of states that a recording sheet is passing through the nip portion between the dielectric drum and a pressure roller shown in FIG. 1.
Figure 10:
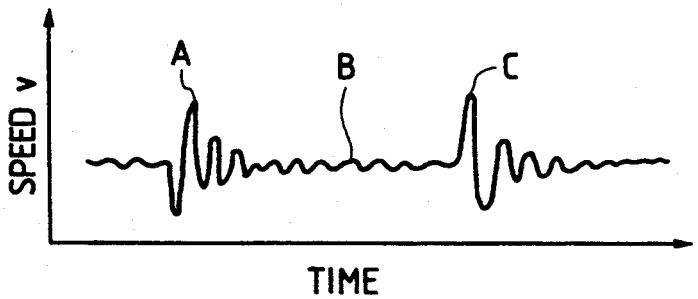
FIG. 10 PRIOR ART
FIG. 10 is a graph showing a variation in the speed of rotation of the dielectric drum shown in FIG. 1.
Figure 11:
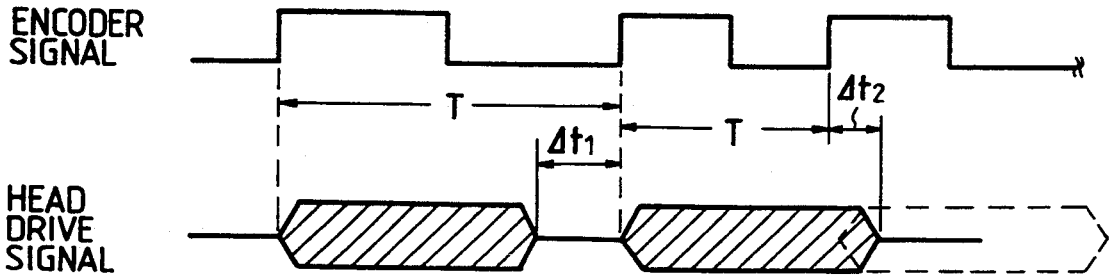
FIG. 11 PRIOR ART
FIG. 11 is a diagram for a description of the recording operation of the apparatus shown in FIG. 1.
Figure 12:
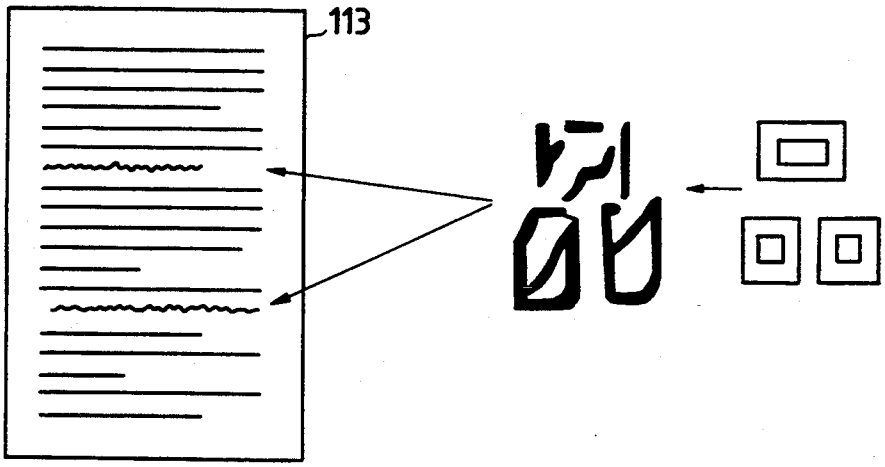
FIG. 12 PRIOR ART
FIG. 12 is a diagram for a description of a recorded image by the apparatus shown in FIG. 1.
Figure 22:
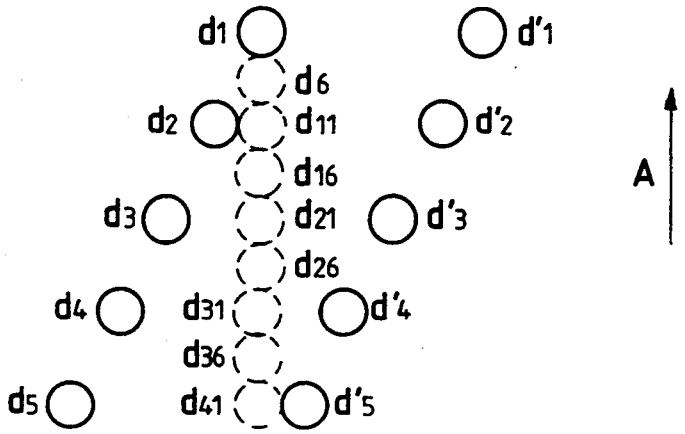
FIGS. 22 and 23 are diagrams for a description of the operation of the electrostatic recording head.

The head drive signals to be applied to each drive electrode 4 and each control electrode 5 include a drive electrode signal and a control electrode signal as will be described later and ions are emitted in the form of dots only from the opening portions 11, 11, . . . to which both electrode signals are applied simultaneously. In FIG. 22, when a pulsed voltage is applied to a first drive electrode 4 and a first control electrode 5 simultaneously, a dot d1 will be printed. As described later, while one pulse is being outputted from an encoder, the first to an N-th drive electrode signals (where N is the number of drive electrodes 4; it is "5" in an example shown in FIG. 8) are sequentially triggered at a predetermined interval Td, while the control electrodes 5 are driven in synchronism with the respective timings, causing dots d1, d2, d3, d4, d5 to be printed sequentially. With a next pulse outputted from the encoder as the dielectric drum 1 rotates, the drive electrodes 4 are sequentially driven from the first onward, thereby printing a dot d6 at a position upstream of (contiguous to) the dot d1 as the dielectric drum 1 rotates. Thereafter, dots d11, d16, d21, d26, d31, d36, d41, and so on are sequentially printed every time a pulse is outputted from the encoder as the dielectric drum 1 rotates. As a result, contiguous to a fifth dot d5' printed by the first pulse from the encoder comes a forty-first dot d41 into line.

Figure 23:
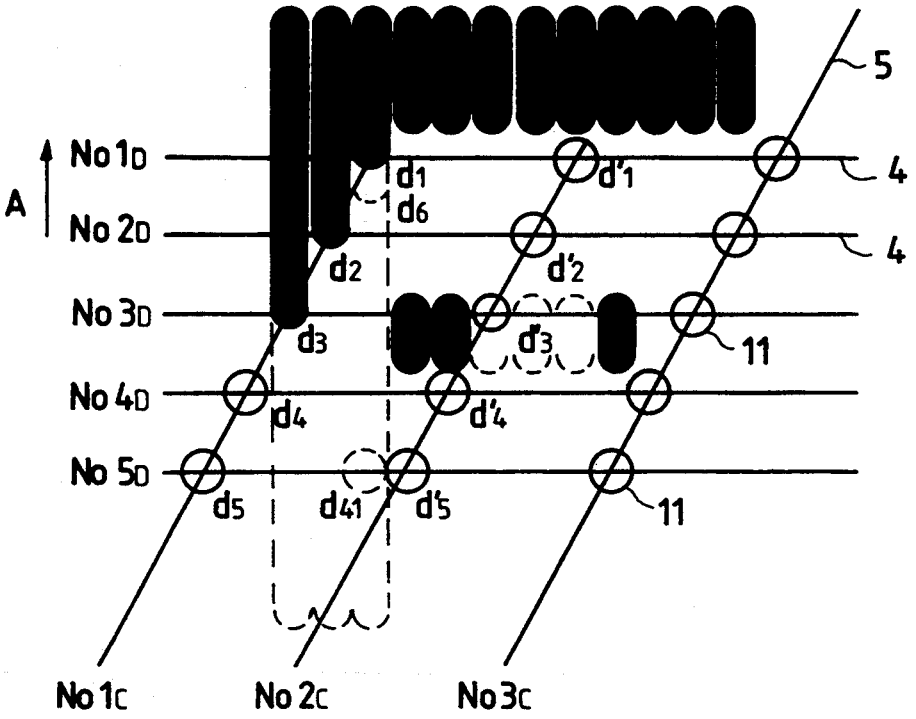

By driving each drive electrode 4 and each control electrode 5, forming the matrix, as described above, for example, an alphabetical character "F" is printed as shown in FIG. 23.

Thus, the latent electrostatic image formed on the surface of the dielectric drum 1 by the electrostatic recording head 2 is made real by a developing unit 16 disposed beside the dielectric drum 1 as shown in FIG. 16 so as to be formed into a toner image. The toner image thus formed on the surface of the dielectric drum 1 is then transferred and fused simultaneously onto a recording sheet 17 fed in synchronism with rotation of the dielectric drum 1 from a not shown sheet feeder.

The transfer and fuse operation of the toner image is performed as follows. The dielectric drum 1 has a pressure roller 18 so that the pressure roller 18 is in pressure contact with the surface of the dielectric drum 1 at a predetermined pressure (e.g., 150 to 200 Kg/cm$^2$). The recording sheet 17 is fed to the nip portion between the dielectric drum 1 and the pressure roller 18 so that the toner image formed on the dielectric drum 1 can be transferred and fused simultaneously onto the recording sheet 17 by pressure.

When the process of transferring and fusing the toner image has been completed as described above, the dielectric drum 1 has not only toner and the like remaining on its surface removed by a cleaner 19 but also charge remaining on its surface discharged by a discharge unit 20.

Figure 24:
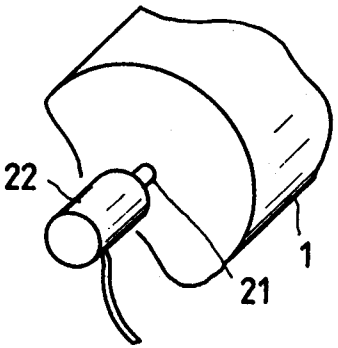
FIG. 24 is a perspective view showing an end portion of a dielectric drum.

By the way, this embodiment includes the pulse generating means for generating pulses at a predetermined period as the latent image carrying body rotates. Specifically, as shown in FIG. 24, the dielectric drum 1 has an encoder 22 serving as the pulse generating means fixed on its rotating shaft 21. It is this encoder 22 that detects the speed of rotation or position of the dielectric drum 1.

Figure 25:
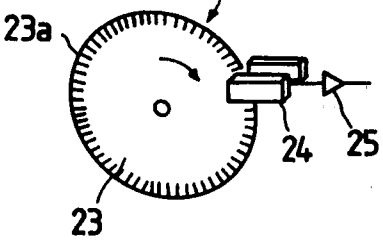
FIG. 25 is a diagram showing the configuration of an encoder.

As shown in FIG. 25, the encoder 22 is firmly fixed on the rotating shaft 21 of the dielectric drum 1 and includes: a rotary disk 23 provided with slits 23*a*, 23*a*, . . . along its outer periphery at a predetermined pitch; a transmission type optical sensor 24, disposed at a point on the outer periphery of the rotary disk 23, for optically detecting the passage of the slits 23*a*, 23*a*, . . . ; and an amplifier 25 for outputting a pulse signal that synchronizes with the passage of the slits 23*a*, 23*a*, . . . .

The encoder 22 detects the speed of rotation or position of the dielectric drum 1 by detecting one full rotation of the rotary disk 23 firmly fixed on the rotating shaft 21 with the optical sensor 24 and outputting a pulse signal that synchronizes with rotation of the rotary disk 23 from the amplifier 25. That is, the encoder 22 outputs a pulse signal having a prescribed period for the output control of the recording head 2.

A block diagram in FIG. 16 shows a signal processing section of the electrostatic recording apparatus which is the embodiment. In FIG. 16, reference numeral 26 designates an image memory for storing print data sent from a not shown host computer; 27, a data assembler for rearranging the print data stored in the image memory 26 so as to match the matrix formed by the drive electrodes 4, 4, . . . and the control electrodes 5, 5, . . . ; 28, an image buffer for temporarily holding the print data sent to the electrostatic recording head 2 from the data assembler 27; 29, a timing generating unit which generates a timing signal for driving the electrostatic recording head 2 based on the print data held in the image buffer 28; 30, a drive circuit for driving the electrostatic recording head 2 by applying a predetermined voltage to the drive electrodes 4, 4, . . . , the control electrodes 5, 5, . . . , and the like on the electrostatic recording head 2; and 31, a control circuit which controls the timing signal for driving the electrostatic recording head 2 in accordance with a signal from the encoder 22.

Figure 26:
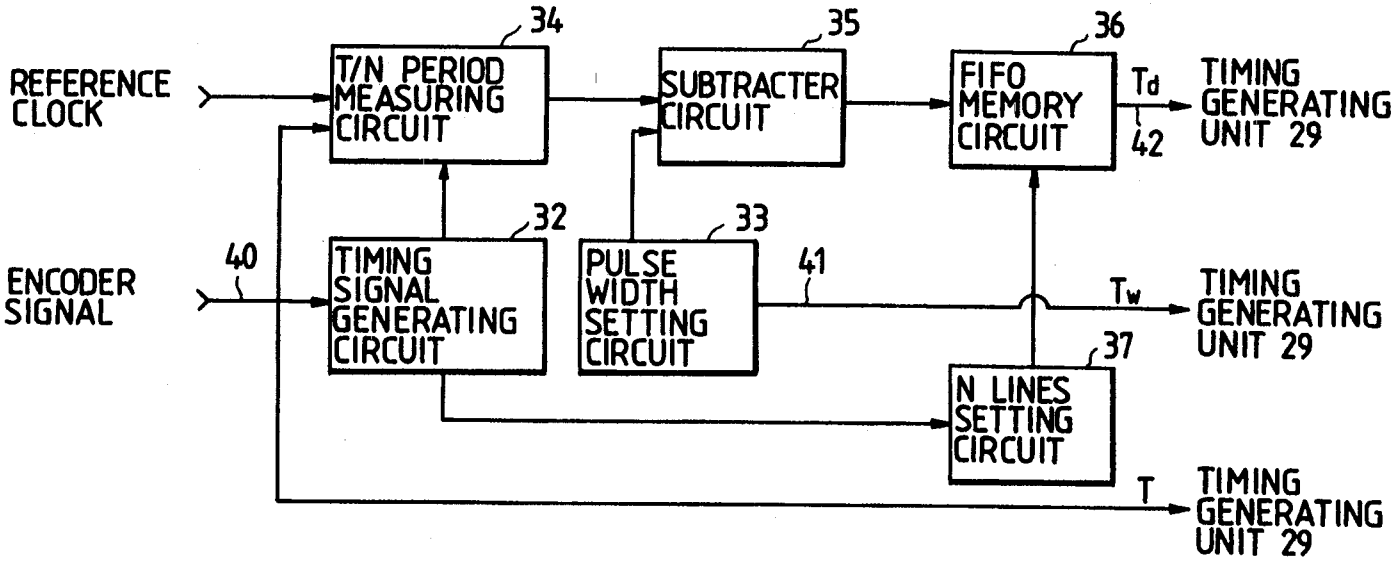
FIG. 26 is a block diagram showing a control circuit.

FIG. 26 shows the configuration of the control circuit in detail. In FIG. 26, reference numeral 32 designates a timing signal generating circuit for generating a predetermined timing signal; 33, a pulse width setting circuit for setting a pulse width Tw of the pulse voltage to be applied to the drive electrodes 4, 4, . . . and the control electrodes 5, 5, . . . on the electrostatic recording head 2; 34, a T/N period measuring circuit for measuring the period T of a pulse signal outputted from the encoder 22 based on a reference clock and calculating a value which is 1/N the period T; 35, a subtracter circuit for subtracting the pulse width Tw set by the pulse width setting circuit 33 from the T/N period measured by the T/N period measuring circuit 34; 36, an FIFO (first-in first-out) memory circuit for outputting signals in the order of storage; and 37, an N lines setting circuit for determining the number N of lines by which the output of the signal stored in the FIFO memory circuit 36 lags with respect to pulse signals consecutively inputted from the encoder 22.

An output pulse 40 from the encoder 22, an output signal 41 from the pulse width setting circuit 33, and an output signal 42 from the FIFO memory circuit 36 are all applied to the timing generating unit 29.

In the above configuration, the electrostatic recording apparatus, which is the embodiment, electrostatically records an image in the following manner. As shown in FIG. 16, print data sent from a host computer (not shown) and written to the image memory 26 is rearranged by the data assembler 27 so as to match the matrix of the electrostatic recording head 2 and stored in the image buffer 28. The print data stored in the image buffer 28 is then outputted to the drive circuit 30 in accordance with the timing signal generated by the timing generating unit 29, thereby recording a latent electrostatic image by driving the electrostatic recording head 2 by the drive circuit 30.

The control circuit 31 controls generation of the timing signal by the timing generating unit 29 in the following manner. As shown in FIG. 26, the control circuit 31 causes the T/N period measuring circuit 34 not only to measure the period T of the pulse signal 40 outputted from the encoder 22 based on the reference clock but also to calculate the T/N period equivalent to a value which is 1/N the period T of the pulse signal 40. The T/N period signal obtained by the T/N period measuring circuit 34 based on the pulse signal 40 from the encoder 22 is then applied to the subtracter circuit 35, where the pulse width Tw preset in the pulse width setting circuit 33 is subtracted from the T/N period signal to calculate the interval Td between the pulse signals. The interval Td between the pulse signals is sent to and temporarily stored in the FIFO memory circuit 36 and outputted therefrom in the order of storage. In this case, each signal 42 outputted from the FIFO memory circuit 36 lags with respect to each pulse signal 40 consecutively inputted from the encoder 22 by the number N of lines set by the N lines setting circuit 37. The pulse width Tw preset in the pulse width setting circuit 33 and the output pulse T from the encoder 22 are applied to the timing generating unit 29, together with the interval Td between the pulse signals.

Accordingly, the timing generating unit 29 generates the timing for printing the print data in the following manner based on the interval Td between the pulse signals sent from the control circuit 31, the pulse width Tw preset in the pulse width setting circuit 29, and the output pulse T from the encoder 22.

Figure 27:
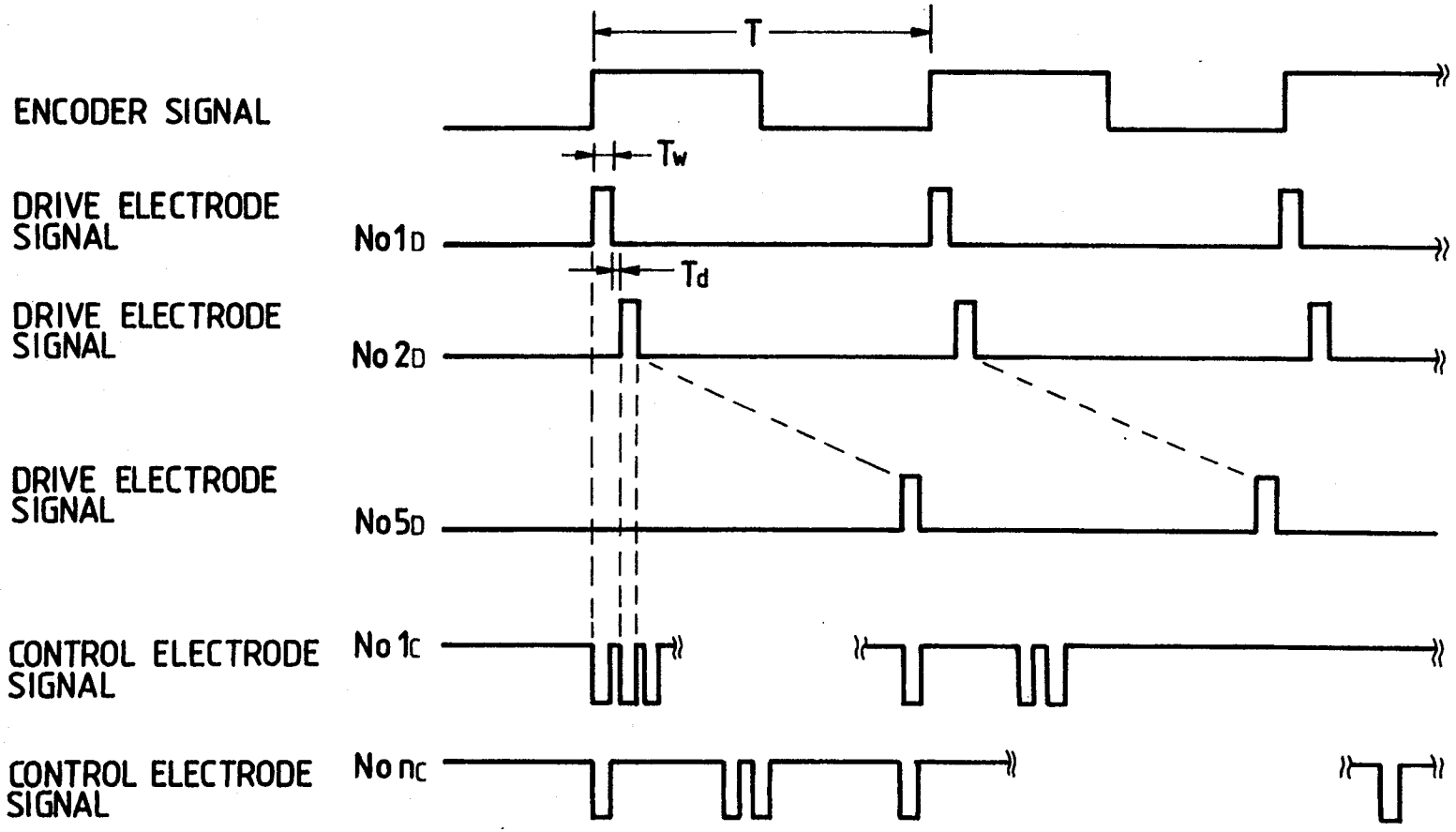
FIG. 27 is a timing chart showing an operation of the control circuit.

As shown in FIG. 27, the electrostatic recording head 2 drive signals include a drive electrode signal and a control electrode signal, and when both signals are turned on simultaneously, a latent image is printed. The drive electrode signals are sequentially turned on in synchronism with the rise of the output pulse T from the encoder 22 in such a manner that a first drive electrode 41, a second drive electrode 42, a third drive electrode 43, and so forth are turned on. In this case, the drive electrode signals are not sequentially turned on based merely on the preset pulse width, but a first drive electrode signal No. $1_D$ is turned on for the pulse width Tw in synchronism with the rise of the output pulse T from the encoder 22, and thereafter, it is when the interval Td between the pulse signals sent from the control circuit 31 has elapsed that a second drive electrode signal No. $2_D$ is turned on for the pulse width Tw. The latent image equivalent to one line is printed by repeating this operation. Each control electrode 5 receives the pulsed control electrode signal in accordance with the print data in synchronism with the drive electrode signal.

By the way, as shown in FIG. 26, the interval Td between the pulse signals sent from the control circuit 31 is obtained by subtracting the pulse width Tw from the quotient T/N resulting from the division of the period T of the pulse signal from the encoder 22 by N. Therefore, a value obtained by first adding the pulse width Tw to the interval Td between the pulse signals and then multiplying the added value by N is equal to the period T of the pulse signal from the encoder 22; i.e., $(Tw+Td)\times N=T$. Thus, even if the period T of the pulse signal from the encoder 22 is changed due to irregular rotation of the dielectric drum 1, the head drive signals are outputted in agreement with the change of the period T of the pulse signal from the encoder 22 at all times. As a result, the change in the period T of the pulse signal from the encoder 22 does not cause distortion to the latent electrostatic image to be recorded.

As described above, the electrostatic recording apparatus, which is the embodiment of the invention, includes: the electrostatic recording head 2 for recording a latent electrostatic image by emitting ions in a matrix form in accordance with an image signal; the dielectric drum 1 which is rotatable and which carries the latent electrostatic image formed by the electrostatic recording head 2; the encoder 22 for generating a pulse at a predetermined period T as the dielectric drum 1 rotates; the timing generating unit 29 for generating a pulse for controlling the output of the electrostatic recording head 2 based on the period T of a pulse outputted from the encoder 22; and the control circuit 31 for controlling the drive electrode signal and the control electrode signal outputted from the timing generating unit 29 based on the period T of the pulse outputted from the encoder 22. Therefore, the speed of rotation of the dielectric drum 1 is detected by the encoder 22, and the output of the drive electrode signal and the control electrode signal from the timing generating unit 29 is controlled by the control circuit 31 based on the period T of the pulse outputted from the encoder 22. As a result, even if the speed of rotation of the dielectric drum 1 is changed due to the recording sheet 17 passing through the nip portion between the dielectric drum 1 and the pressure roller 18 that is in pressure contact therewith, the electrostatic recording head 2 can be driven in synchronism with the speed of rotation of the dielectric drum 1 at all times, thereby allowing the recording of distortion-free, high-quality images.

Figure 28:
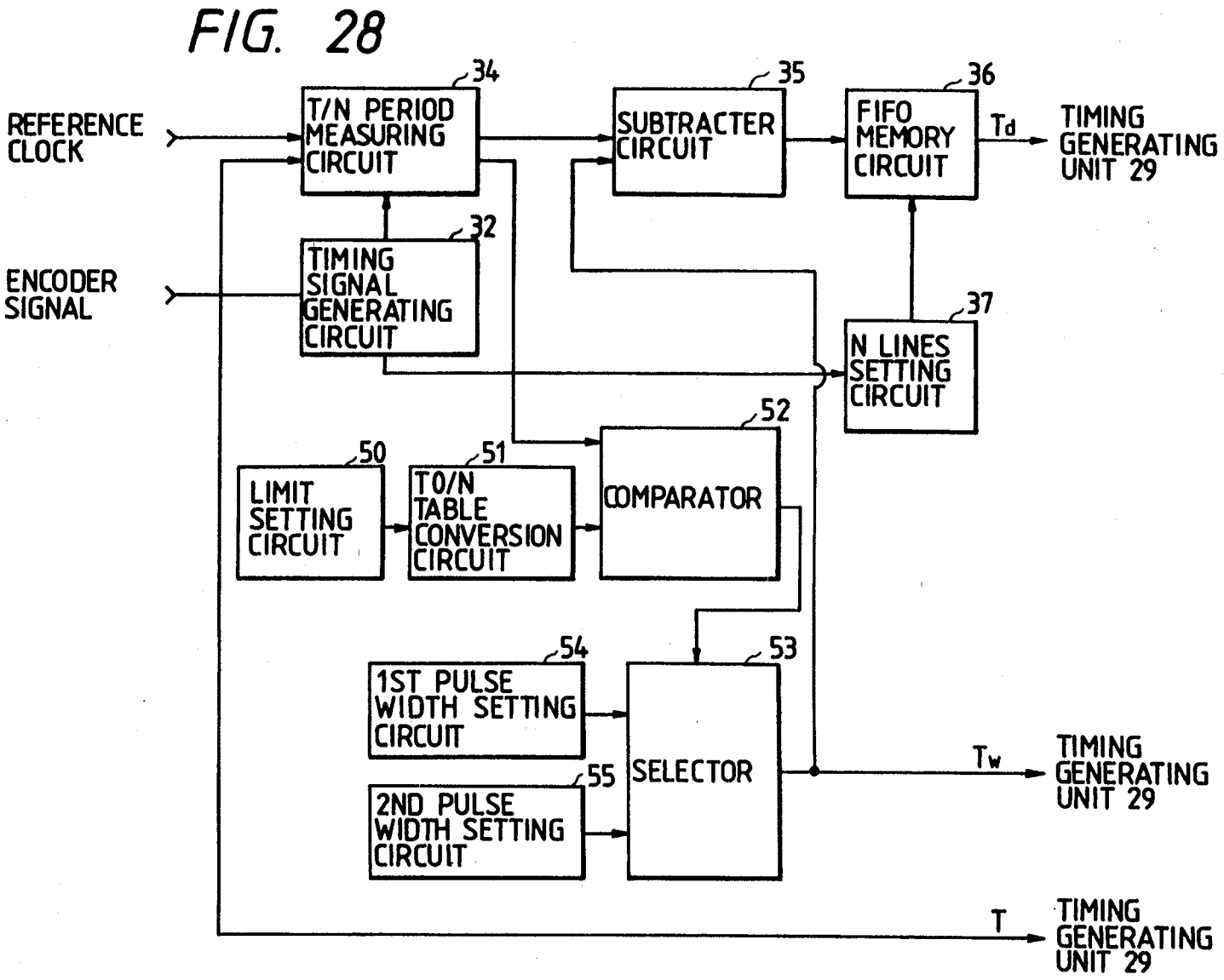
FIG. 28 is a block diagram showing a control circuit according to a second embodiment of the invention.

FIG. 28 shows a second embodiment of the invention. Like reference numerals and characters in this embodiment designates like parts and components in the previous embodiment. In this embodiment, the speed of rotation of the dielectric drum is higher than a predetermined value. As a result, even if the period T of a pulse outputted from the encoder is shorter than a predetermined value, all the drive signals can be outputted to the electrostatic recording head within the period T.

Figures 29A, 29B, 29C:
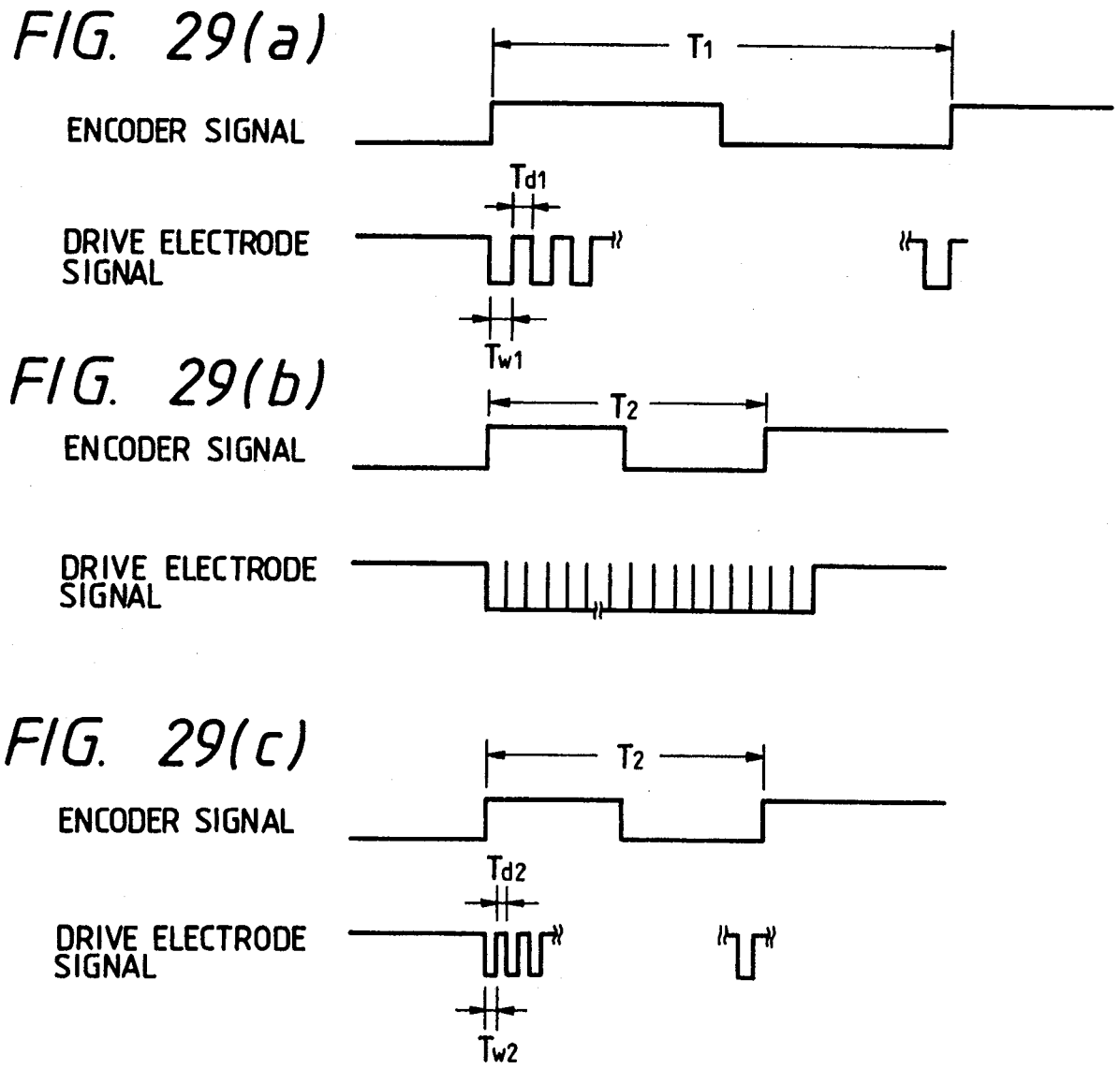
FIGS. 29(*a*), 29(*b*) and 29(*c*) are timing charts showing an operation of the embodiment shown in FIG. 28.

When the speed of rotation of the dielectric drum 1 is higher than a predetermined value and the period T of a pulse outputted from the encoder 22 is shorter than a predetermined value, it is not possible to output all the drive signals within the period T of the pulse outputted from the encoder 22 as shown in FIG. 29(*b*) even if the interval Td between the pulse signals outputted from the timing generating unit 29 is eliminated, because the pulse width Tw remains unchanged. This causes missing portions and a like defect in the recorded image.

To allow all the drive signals to be outputted within the period T of the pulse outputted from the encoder 22 even if the period T of the pulse 40 outputted from the encoder 22 is shorter than the predetermined value, this embodiment causes the pulse width Tw and the interval Td between the pulse signals to be changed by checking whether or not the value obtained by dividing the period T of the pulse from the encoder 22 by N is smaller than the predetermined value.

FIG. 28 is a block diagram showing the control circuit. In FIG. 28, reference numeral 50 designates a limit setting circuit for setting a value T0 which determines whether or not the circuits of this embodiment should be operated when the period T of the pulse outputted from the encoder 22 becomes smaller than a predetermined value T0; 51, a T0/N table conversion circuit for calculating a value which is 1/N the value T0 set to the limit setting circuit 50; 52, a comparator for comparing the value T/N outputted from the T/N period measuring circuit 34 with the value T0/N outputted from the T0/N table conversion circuit 51; and 53, a selector for switching between a first pulse width setting circuit 54 and a second pulse width setting circuit 55 based on a comparator 52 output.

In this embodiment, upon input of the pulse outputted from the encoder 22 to the control circuit 31, the value which is 1/N the period T of this pulse is measured by the T/N period measuring circuit 34, and the measured value T/N is compared with the value set to the limit setting circuit 50 by the comparator 52 and then converted by the T0/N table conversion circuit 51. If the value T/N is greater than the value T0/N, the first pulse width setting circuit 54 is selected by the selector 53 based on the output signal from the comparator 52, and the electrostatic recording head 2 is driven as shown in FIG. 29(*a*) based on a pulse width Tw1 and a pulse interval Td1 similar to those in the previous embodiment set by the first pulse width setting circuit 54.

On the other hand, if the value T/N is smaller than the value T0/N, the second pulse width setting circuit 55 is selected by the selector 53 based on the signal outputted from the comparator 52, and the electrostatic recording head 2 is driven based on a pulse width Tw2 set by the second pulse width setting circuit 55. This pulse width Tw2 is set to a value smaller than the pulse width Tw1 set by the first pulse width setting circuit 54.

In this way, even if the period T of the pulse 40 outputted from the encoder 22 is smaller than the predetermined value, not only the pulse for driving each drive electrode 4 and the like is set to the pulse width Tw2 that is smaller than the normal pulse width as shown in FIG. 29(*c*), but also the interval Td2 between the pulses is made shorter commensurate therewith, thereby allowing all the head drive signals to be outputted within the period T of the pulse outputted from the encoder 22 and preventing missing portions in the recorded image.

Since other construction and operation of this embodiment are identical as those of the previous embodiment, their descriptions will be omitted.

Figure 30:
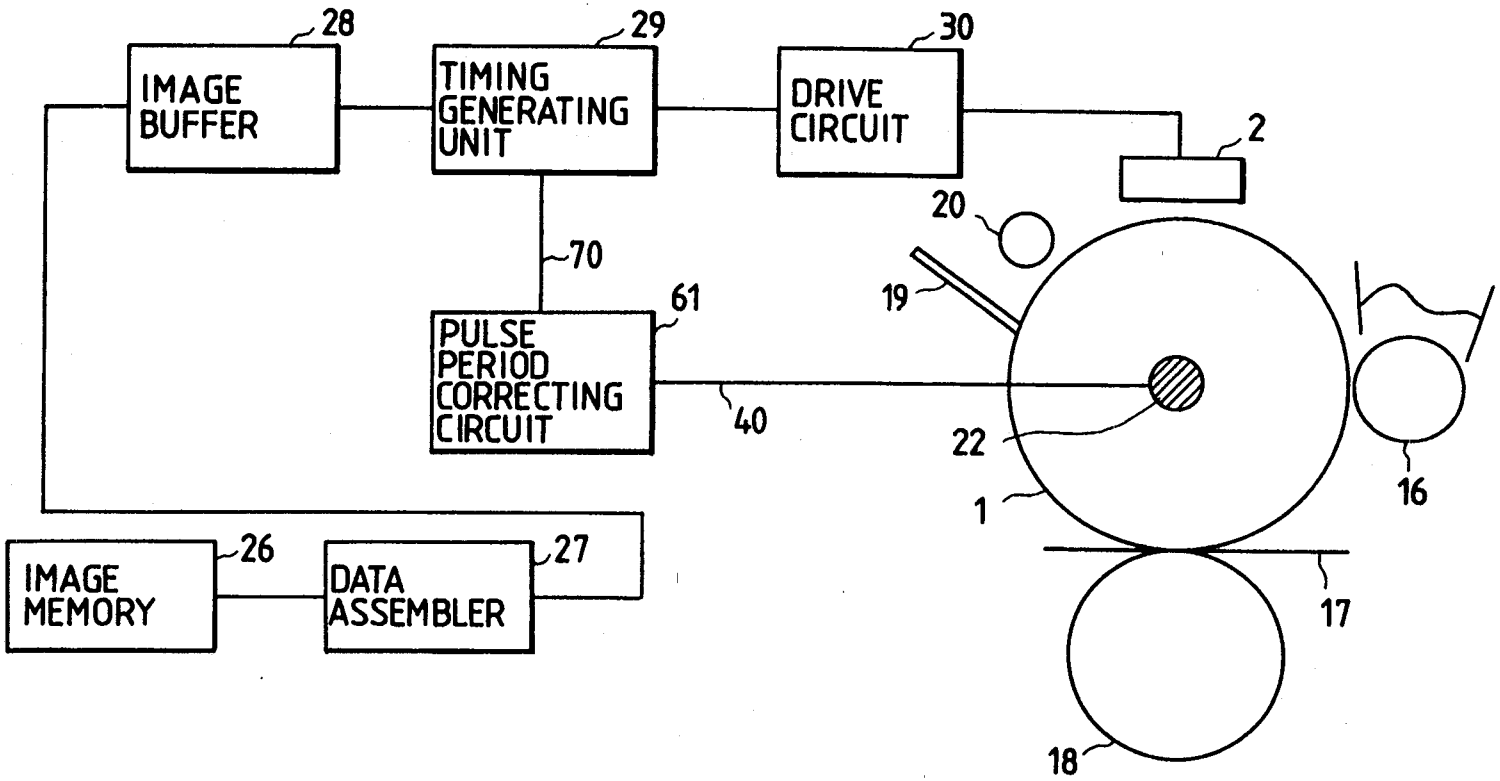
FIG. 30 is a diagram showing the configuration of an electrostatic recording apparatus according to a third embodiment of the invention can be applied.

FIG. 30 shows an electrostatic recording apparatus according to a third embodiment of the invention, in which the control circuit of the first embodiment (FIG. 16) is replaced by a pulse period correcting circuit 61 for correcting the period of the pulse signal outputted from the encoder 22.

Figure 31:
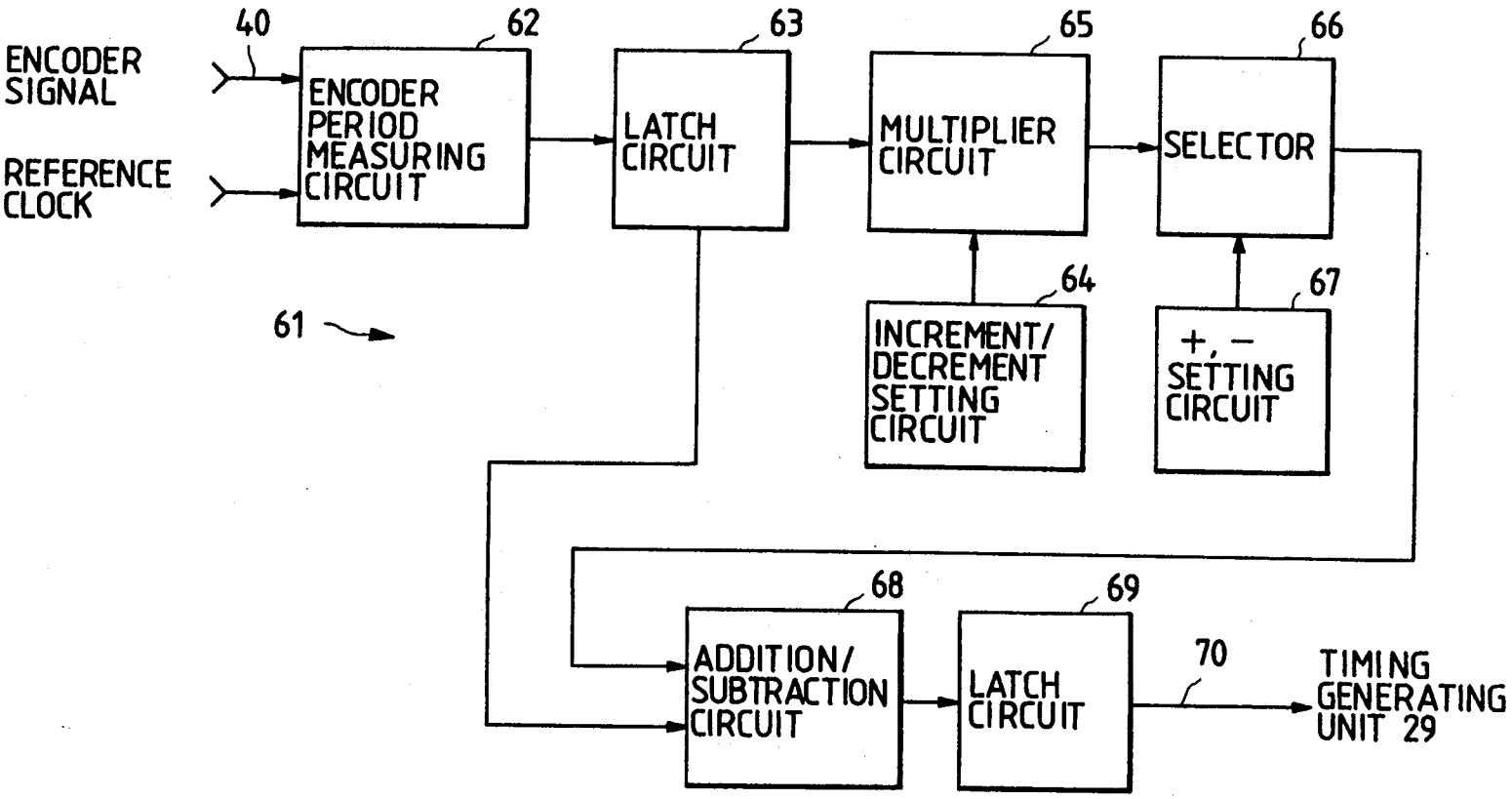
FIG. 31 is a block diagram showing a main portion of the electrostatic recording apparatus shown in FIG. 30.

FIG. 31 shows the configuration of the pulse period correcting circuit in more detail. In FIG. 31, reference numeral 62 designates an encoder period measuring circuit which measures the period T of a pulse signal outputted from the encoder 22 based on a reference clock; 63, a latch circuit which latches a measured value from the encoder period measuring circuit 62; 64, an increment/decrement setting circuit which sets a correcting value to be added to the pulse period measured by the encoder period measuring circuit 62; 65, a multiplier circuit which multiplies the pulse period latched by the latch circuit 63 based on the correcting value set at the increment/decrement setting circuit 64; 66, a selector which switches between addition and subtraction of the correcting value calculated by the multiplier circuit 65 to or from the pulse period T measured by the encoder period measuring circuit 62; 67, a setting circuit which specifies addition or subtraction by the selector 66; 68, an addition/subtraction circuit which adds or subtracts the correcting value calculated by the multiplier circuit 65 to and from the measured period T from the encoder held at the latch circuit 63; and 69, a latch circuit which latches the value calculated by the addition/subtraction circuit 68.

In the above configuration, the electrostatic recording apparatus, which is the embodiment of the invention, electrostatically records an image in the following manner. As shown in FIG. 30, print data sent from the not shown host computer and written to the image memory 26 is rearranged so as to match the matrix of the electrostatic recording head 2 by the data assembler 27 and stored in the image buffer 28. The print data stored in the image buffer 28 is then outputted to the drive circuit 30 in accordance with the timing signal generated by the timing generating unit 29, thereby recording a latent electrostatic image by driving the electrostatic recording head 2 by the drive circuit 30.

In this case, generation of the timing signal by the timing generating unit 29 is determined by a pulse signal 40 outputted from the encoder 22. However, the pulse signal 40 is not directly responsible for the generation, but a pulse period corrected by the pulse period correcting circuit 61 plays the central role in the following way.

As shown in FIG. 31, the pulse period correcting circuit 61 measures the period T of the pulse signal 40 outputted from the encoder 22 based on the reference clock using the encoder period measuring circuit 62. The period signal of the pulse signal 40 outputted from the encoder 22 measured by the encoder period measuring circuit 62 is not only latched by the latch circuit 63 but also sent to the multiplier circuit 65, where the period signal is multiplied by a value preset at the increment/decrement setting circuit 64. The increment/decrement setting circuit 64 sets an increment/decrement so that the pitch according to the interval between the drive electrodes 4, 4, . . . of the electrostatic recording head 2 and the pitch according to the pulses outputted from the encoder 22 become identical to each other. The correcting value calculated by the multiplier circuit 65 is then sent to the selector 66, which selects addition or subtraction of the correcting value as set by the setting circuit 67.

Then, the correcting value is added to or subtracted from the value latched at the latch circuit 63 by the addition/subtraction circuit 68. The added or subtracted value is outputted to the timing generating unit 29 through the latch circuit 69.

The timing generating unit 29 generates a timing signal for driving the electrostatic recording head 2 in accordance with the print data based on the pulse width Tw and pulse interval Td preset at itself in the following way, using a corrected pulse signal 70 sent from the pulse period correcting circuit 61.

As shown in FIG. 27, the drive signals of the electrostatic recording head 2 include a drive electrode signal and a control electrode signal. The latent image is printed when both the drive electrode signal and the control electrode signal are turned on simultaneously. The drive electrode signals are sequentially turned on in synchronism with the rise of the pulse T′ corrected by the pulse period correcting circuit 61 in such a manner as to turn on a first drive electrode 4-1, a second drive electrode 4-2, a third drive electrode 4-3, and so on. In this case, the drive electrode signals are sequentially turned on based on the preset pulse width Tw and then outputted from the encoder 22. A first drive electrode signal No. $1_D$ is turned on in synchronism with the rise of the pulse whose period is T′ corrected by the pulse period correcting circuit 61 for the pulse width Tw, and thereafter, when the interval Td between the pulse signals sent from the correcting circuit 61 has passed, a second drive electrode signal No. $2_D$ is turned on for the pulse width Tw. The same operation is repeated so that the latent image equivalent to one line is printed. In this case, the control electrode 5 receives a pulsed control electrode signal in accordance with the print data and in synchronism with the drive electrode signal.

By the way, the corrected pulse signal 70 outputted from the pulse period correcting circuit 61 is a value obtained by correcting the period T of the pulse outputted from the encoder 22 based on the value set by the increment/decrement setting circuit 64. Therefore, even if there is any variation in the pitch between the drive electrodes 4, 4, . . . on the electrostatic recording head 2 or any errors in the number of pulses outputted from the encoder 22 or in the diameter of the dielectric drum 1, the pitch d between the dots printed by the adjacent drive electrodes 4, 4, . . . on the electrostatic recording head 2 is made equal to the value obtained by multiplying by a predetermined integer n the pitch P between the dots sequentially printed in accordance with the pulses outputted from the encoder 22.

Figure 13:
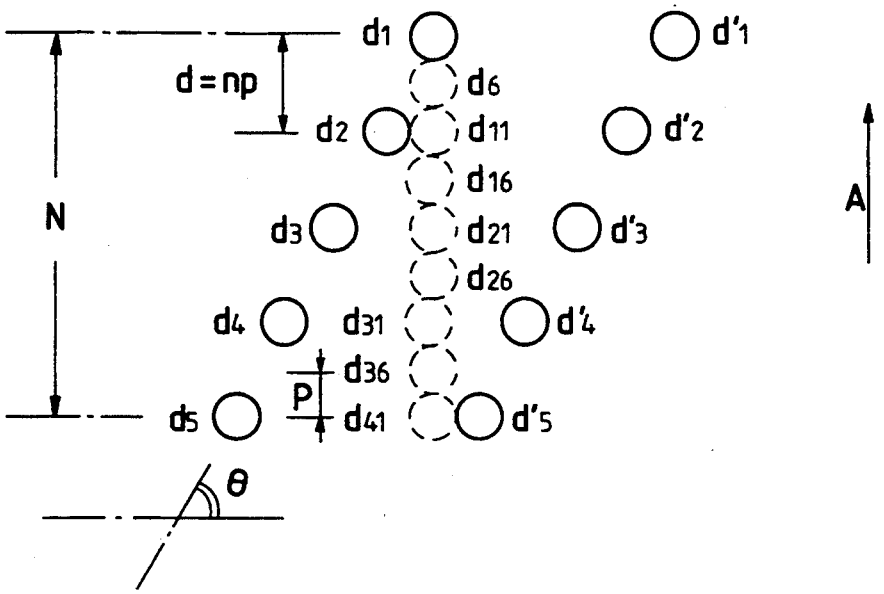
FIG. 13 PRIOR ART
FIG. 13 is a timing chart and a diagram for a description of the recording operation of the electrostatic recording head shown in FIG. 1.
Figure 14:
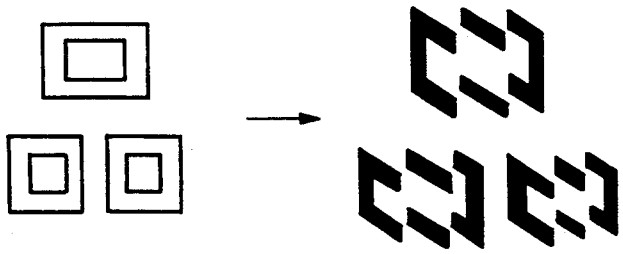
FIG. 14 PRIOR ART
FIG. 14 is a diagram for a description of another recorded image.
Figure 15:
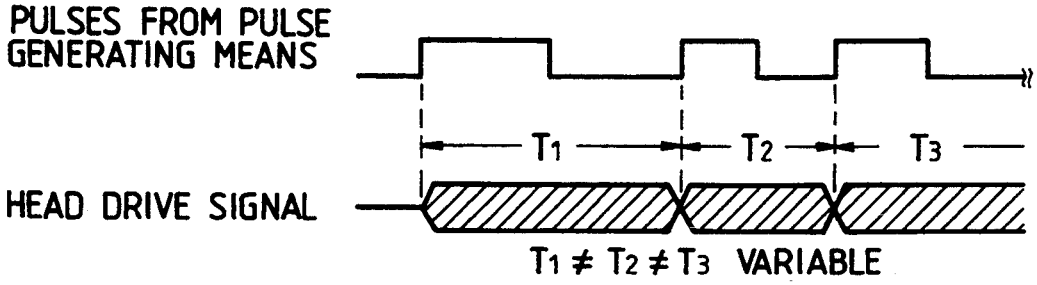
FIG. 15 is a diagram for a description of the concept of an electrostatic recording method according to the invention.

Specifically, the pitch P which is 1/n the pitch d between the dots printed by the adjacent drive electrodes 4, 4, . . . on the electrostatic recording head 2 can be given by equation (4) as shown in FIG. 13.

$$P=d'/(n-1/N) \quad (4).$$

The value P is indiscriminately determined by the geometric pitch d' between the drive electrodes 4, 4, . . . on the electrostatic recording head 2, the number n of dots printed at the pitch d', and the number N of the drive electrodes 4, 4, . . . on the electrostatic recording head 2.

In contrast thereto, the period T of the pulse signal 40 outputted from the encoder 22 is corrected so as to be equal to the pitch between the drive electrodes 4, 4, . . . on the electrostatic recording head 2 by the pulse period correcting circuit 61.

With respect to the pitch P which is 1/n the pitch d between the dots to be printed by the adjacent drive electrodes 4, 4, . . . on the electrostatic recording head 2, let us think about the case where a 10-dots/mm printing is to be performed on a dielectric drum 1 whose diameter is 200 mm using an electrostatic recording head 2 in which the pitch d' between the drive electrodes 4, 4, . . . viewed from the dielectric drum 1 is 0.2 mm, n is 2, and the number N of the drive electrodes 4, 4, . . . is 5. If the number NE of pulses outputted per rotation of the encoder 22 is 6000, the pitch P to be given by equation (4) is as follows.

$$P=0.2/(2-1/5)\approx 0.111.$$

In contrast thereto, the pitch P' before correction to be given by equation (5) is as follows.

$$P=200\pi/6000\approx 0.105.$$

Thus, there exists a difference of 0.006 mm between both pitches P and P'.

The pulse period correcting circuit 61 corrects the period in such a manner that the period T of the pulse from the encoder 22 will be increased by 5.71%. Accordingly, the pitch P' of the pulses outputted from the encoder 22 after correction is as follows.

$$P'=0.105+0.105\times 0.0571\approx 0.1109955.$$

As a result, the difference between the pitch P and the corrected pitch P' is 0.0000045 mm (0.111−0.1109955). This is an error of 0.000036 mm (0.036 μm), or only about 1/3000 dot out of place compared to a pre-corrected error of 0.048 mm (48 μm), or ½ dot out of place, making the post-corrected error practically negligible.

Figure 32A:
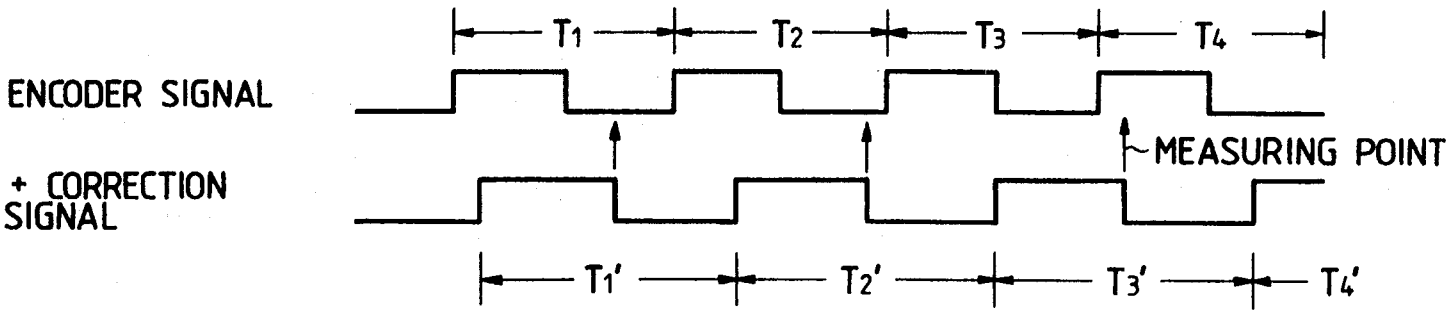
FIGS. 32(*a*) and 32(*b*) are timing charts showing the operation of the electrostatic recording apparatus shown in FIG. 30.
Figure 32B:
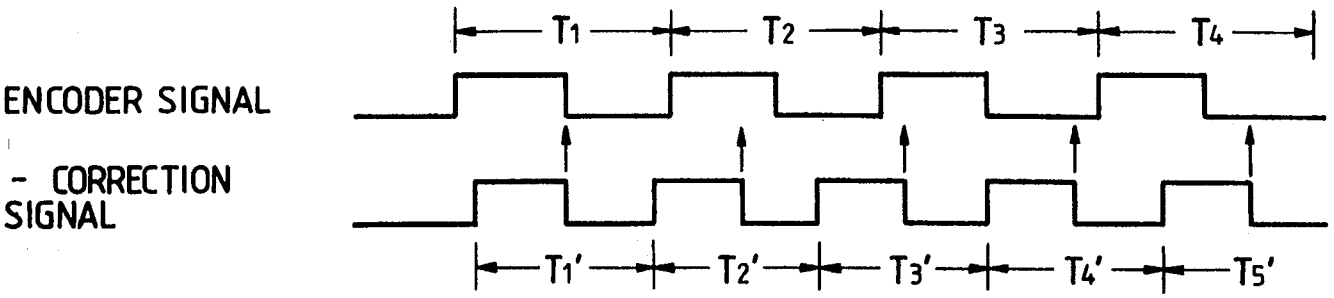

As shown in FIG. 32(*a*), the pulse 70 corrected by the pulse period correcting circuit 61 sends the signals to the timing generating unit 29 to control the drive of the electrostatic recording head 2. FIG. 32(*b*) shows the case where the pulse period is subjected to a negative correction.

Since this system produces a new pulse signal 70 by correcting the pulse signal 40 from the encoder 22 by the pulse period correcting circuit 61, the pulse signal 40 from the encoder 22 may be out-of-period with respect to the corrected pulse signal 70 for a number of periods. Thus, the embodiment seeks to prevent this inconvenience by applying to a next pulse the period which is measured while the corrected signal 70 is being outputted.

More specifically, as shown in FIG. 32(*a*), the period T of the pulse 40 is measured while the corrected pulse Ti' is being outputted, and the measured period T1 is corrected to prepare the pulse signal 70 whose period is T2'. While the pulse signal 70 whose period is T2' is being outputted, the period T2 of the pulse signal 40 is measured, and while the pulse signal 70 whose period is T3' is being outputted, the period T4 of the pulse signal 40 is measured, jumping the period T3. Therefore, the incoincidence in the period between the pulse signal 40 from the encoder 22 and the corrected pulse signal 70 can be confined within 1 to 2 pulses, thereby eliminating the problem of making the incoincidence in the period between the pulse signal 40 from the encoder 22 and the corrected pulse signal 70 so critical as involving a number of period.

FIG. 32(*b*) shows the case where the negative correction is made. In this case, since the period of the corrected pulse signal 70 is shorter than that of the pulse signal 40 from the encoder 22, the period T3 of the pulse signal 40 is measured twice to adjust the proper timing.

Such timing control is effected, e.g., as follows. While the period is updated at the latch circuit 69 every time the encoder period is measured, a new period written to the latch circuit is read by a printing circuit upon end of printing.

Thus, as shown in FIG. 32(*a*), the new period is always written to the latch circuit whenever the printed character is elongated, thereby printing with the latest period. That is, the old period is deleted from the latch circuit and a new period is latched during printing, and this operation is repeated at a different period. As shown in FIG. 32(*b*), if the character is printed short, the old data is read from the latch circuit repeatedly until the new period is latched.

If the new data is written to the latch circuit at the very moment that the latch data is being read, the print operation gets confused. Thus, in this case, the latch circuit is disabled so that no data will be written thereto.

As described above, even if there is a difference between the pitch P which is ½ the pitch d of the dots printed by the adjacent drive electrodes 4, 4 on the electrostatic recording head 2 and the pitch P' determined by the pulse outputted from the encoder 22, both pitches P and P' can be made equal to each other by correcting the period of the pulse outputted from the encoder 22, thereby allowing the dots to be printed in place and recording the high-quality image.

Thus, the electrostatic recording apparatus, which is the embodiment of the invention, comprises the electrostatic recording head 2 which records a latent electrostatic image by emitting ions in a matrix form in accordance with an image signal; the dielectric drum 1 which is rotatable and which carries the latent electrostatic image formed by the electrostatic recording head 2; the encoder 22 which generates a pulse for controlling the output of the electrostatic recording head 2 at a predetermined period as the dielectric drum 1 rotates; and the pulse period correcting circuit 61 which corrects the period of the pulse 40 outputted from the encoder 22; and the output of the electrostatic recording head 2 is controlled by the pulse 70 corrected by the pulse period correcting circuit 61. Therefore, even if there is a difference between the pitch P of the drive electrodes 4, 4 on the electrostatic recording head 2 and the detected speed of rotation of the dielectric drum 1, the output of the electrostatic recording head 2 can be controlled by the pulse 70 corrected by the pulse period correcting circuit 61. As a result, the pitch P between the drive electrodes 4, 4 on the electrostatic recording head 2 and the pitch P' between the pulses 40 outputted from the encoder 22 can be made equal to each other, thereby preventing the dots forming the recorded image from being printed out of place and allowing the high-quality image to be recorded.

The construction and operation of the invention are as described in the foregoing. Even if the speed of rotation of the latent image carrying body is changed due to the recording member threading into the nip portion between the latent image carrying body and the pressure roller that is in pressure contact therewith, the timing for driving the electrostatic recording head can be controlled so that the image will not be distorted. Therefore, the invention can provide the electrostatic recording method and apparatus which are capable of recording high-quality images.

The invention can also provide the electrostatic recording method and apparatus which are capable of recording high-quality images in which the dots are printed in place even if there is a difference between the pitch according to the interval of the drive electrodes of the electrostatic recording head and the pitch according to the pulses outputted from the encoder, or a like error.

What is claimed is:

1. An electrostatic recording method for forming latent electrostatic images on a rotatable dielectric drum in a matrix form in accordance with an image signal by an electrostatic recording head, and images are recorded by developing the latent electrostatic image, said method comprising the steps of:

forming the latent electrostatic images on the dielectric drum in a matrix form in accordance with the image signal;

passing a transfer sheet between a nip portion formed at an area where the dielectric drum and a pressure roller are in pressure contact with each other;

detecting a rotational speed of the dielectric drum; and controlling a drive timing of the recording head so as to compensate for a change in the detected rotational speed caused by passage of the transfer sheet through the nip between the dielectric drum and pressure roller.

2. An electrostatic recording apparatus comprising:

a rotatable dielectric drum for carrying latent electrostatic images;

a pressure roller in pressure contact with the dielectric drum to form a nip portion through which a transfer sheet is passed;

an electrostatic recording head for forming the latent electrostatic images on the dielectric drum in a matrix form in accordance with an image signal;

pulse generating means for generating a pulse signal in accordance with a rotational speed of the dielectric drum as the transfer sheet passes through the nip between the dielectric drum and the pressure roller;

timing signal generating means for generating a timing signal to be used for driving the recording head on the basis of the pulse signal from the pulse generating means and a control signal; and control means for providing the control signal to the timing signal generating means on the basis of the period of the pulse signal so that the timing signal generating means generates the timing signal having a drive period with is consistent with the period of the pulse signal.

3. The apparatus according to claim 2, wherein the control means comprises means for measuring the period of the pulse signal from the pulse generating means and calculating the drive period which is 1/N of the measured period where N is a number of matrix elements of the recording head in a rotational direction of the dielectric drum, means for subtracting a predetermined pulse width of the timing signal from the calculated drive period to determine a pulse interval of the timing signal, and means for providing the timing signal generating means with the control signal representing the determined pulse interval and the predetermined pulse width of the timing signal.

4. The apparatus according to claim 3, wherein the control means further comprises means for setting a plurality of pulse widths of the timing signal, and means for selecting the predetermined pulse width from among the plurality of pulse widths depending on the calculated drive period.

5. An electrostatic recording method for forming latent electrostatic images on a rotatable dielectric drum in a matrix form in accordance with an image signal by an electrostatic recording head, and images are recorded by developing the latent electrostatic image, said method comprising the steps of:

forming the latent electrostatic images on the dielectric drum in a matrix form in accordance with the image signal;

passing a transfer sheet between a nip portion formed at an area where the dielectric drum and a pressure roller are in pressure contact with each other;

detecting a rotational speed of the dielectric drum;

correcting the detected rotational speed to compensate for a change in rotational speed of the dielectric drum caused by passage of the transfer sheet through the nip; and controlling a drive timing of the recording head on the basis of the corrected rotational speed.

6. The method according to claim 5, wherein the detected rotational speed is corrected so as to become consistent with a pitch, in a rotational direction of the dielectric drum, of matrix elements of the recording head.

7. An electrostatic recording apparatus comprising:

a rotatable dielectric drum for carrying latent electrostatic images;

a pressure roller in pressure contact with the dielectric drum to form a nip portion through which a transfer sheet is passed;

an electrostatic recording head for forming the latent electrostatic images on the dielectric drum in a matrix form in accordance with an image signal;

pulse generating means for generating a first pulse signal having a first period in accordance with a rotational speed of the dielectric drum as the transfer sheet passes through the nip between the dielectric drum and the pressure roller;

correcting means for correcting the first period of the first pulse signal to obtain a second pulse signal having a second period; and timing signal generating means for generating a timing signal to be used for driving the recording head on the basis of the second pulse signal.

8. The apparatus according to claim 7, wherein the correcting means obtains the second pulse signal having the second period which is consistent with a pitch, in a rotational direction of the dielectric drum, of matrix elements of the recording head.

9. The apparatus according to claim 7, wherein the correcting means comprises means for measuring the first period of the first pulse signal, means for setting a correction rate of the first period, and means for calculating the second period on the basis of the measured first period and the set correction rate.

* * * * *

UNITED STATES PATENT AND TRADEMARK OFFICE

CERTIFICATE OF CORRECTION

PATENT NO. : 5,420,616

DATED : May 30, 1995

INVENTOR(S) : Yuji SUEMITSU et al.

It is certified that error appears in the above-indentified patent and that said Letters Patent is hereby corrected as shown below:

Claim 2, column 20, line 14, "with" (first occurrence) should read --which--.

Signed and Sealed this

Eleventh Day of June, 1996

*Attest:*

Bruce Lehman

BRUCE LEHMAN

*Attesting Officer*

*Commissioner of Patents and Trademarks*